US006918335B2

(12) United States Patent
Choi et al.

(10) Patent No.: US 6,918,335 B2
(45) Date of Patent: Jul. 19, 2005

(54) DUAL CAPACITY COMPRESSOR

(75) Inventors: Cheal Lak Choi, Gimhae-si (KR); Dal Soo Kang, Changwon-si (KR); Chul Gi Roh, Changwon-si (KR); Min Young Seo, Changwon-si (KR); Kee Joo Kim, Changwon-si (KR); June Soo Hur, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/695,858

(22) Filed: Oct. 30, 2003

(65) Prior Publication Data

US 2004/0168569 A1 Sep. 2, 2004

(30) Foreign Application Priority Data

| | | |
|---|---|---|
| Oct. 31, 2002 | (KR) | 10-2002-0067271 |
| Oct. 31, 2002 | (KR) | 10-2002-0067272 |
| Oct. 31, 2002 | (KR) | 10-2002-0067273 |
| Oct. 31, 2002 | (KR) | 10-2002-0067274 |
| Oct. 31, 2002 | (KR) | 10-2002-0067275 |
| Oct. 31, 2002 | (KR) | 10-2002-0067276 |
| Oct. 31, 2002 | (KR) | 10-2002-0067270 |

(51) Int. Cl.[7] ..... F04B 1/06
(52) U.S. Cl. ..... 92/13; 92/140; 417/221
(58) Field of Search ..... 92/13, 13.7, 140; 417/221

(56) References Cited

U.S. PATENT DOCUMENTS 6,755,624 B2 * 6/2004 Bae et al. ..... 92/13

* cited by examiner

*Primary Examiner*—Thomas E. Lazo
(74) *Attorney, Agent, or Firm*—Fleshner & Kim LLP

(57) ABSTRACT

Dual capacity compressor including a power generating part including a reversible motor and a crank shaft inserted in the motor, a compression part including a cylinder, a piston in the cylinder, and a connecting rod connected to the piston, a crank pin in an upper part of the crank shaft eccentric to an axis of the crank shaft, an eccentric sleeve having an inside circumferential surface rotatably fitted to an outside circumferential surface of the crank pin, and an outside circumferential surface rotatably fitted to an end of the connecting rod, a key member for coupling the eccentric sleeve with the crank pin positively in all rotation directions of the motor, and damping means for damping impact occurred between the eccentric sleeve and members adjoin thereto, thereby preventing relative motion and wear/noise between parts that maintain an eccentricity.

50 Claims, 23 Drawing Sheets

DUAL CAPACITY COMPRESSOR

This application claims the benefit of the Korean Application Nos. P2002-0067270 to P2002-0067276 filed on Oct. 31, 2002, which are hereby incorporated by reference.

BACKGROUND OF THE INVENTION

1. Field of the Invention

The present invention relates to compressors for compressing a working fluid, such as refrigerant, to a required pressure, and more particularly, to a compressor of which compression capacity changes with a direction of rotation.

2. Background of the Related Art

The dual capacity compressor is a kind of reciprocating type compressor of which piston stroke and compression capacity are made different depending on rotation directions of a motor and a crankshaft by means of an eccentric sleeve rotatably coupled with a crank pin of a crankshaft. Since the dual capacity compressor has a compression capacity that can be changed depending on a required load, the dual compressor is used widely in apparatuses which require compression of working fluid, particularly in home appliances operative in a refrigeration cycle, such as a refrigerator, for enhancing an operation efficiency. A U.S. Pat. No. 4,236,874 discloses a general dual capacity compressor, referring to which a related art dual capacity compressor will be described, briefly.

FIG. 1 illustrates a section of a dual capacity compressor disclosed in the U.S. Pat. No. 4,236,874, and FIG. 2 illustrates operation of the dual capacity compressor, schematically.

Referring to FIG. 1, the dual capacity compressor is provided with a piston 7 in a cylinder 8, a crankshaft 1, a crank pin 3 having an axis 3*a* eccentric from an axis 1*a* of the crankshaft 1, an eccentric ring 4 coupled with the crank pin 3, and a connecting rod 6 connected between the eccentric ring 4 and the piston 7, as key components. The eccentric ring 4 and the connecting rod 6 are rotatable with respect to each other, as well as the axis 3*a* of the crank pin. There are release areas 9 in contact surfaces of the crank pin 3 and the eccentric ring 4 respectively, and a key 5 for coupling the crank pin 3 with the eccentric ring 4 in the release areas. The operation of the dual capacity compressor with respect to the compression capacity will be described. As shown in FIG. 2, in the dual capacity compressor, a stroke of the piston 7 is regulated by an eccentricity varied with a position of the eccentric ring 4, wherein, if a large capacity is required, the crank shaft 1 is rotated in a clockwise direction (regular direction) and, if a small capacity is required, the crank shaft 1 is rotated in a counter clockwise direction (reverse direction). In detail, FIG. 2A illustrates a moment the piston 7 is at a top dead center during a clockwise direction rotation, and FIG. 2B illustrates a moment the piston 7 is at a bottom dead center during a clockwise direction rotation, when the stroke Lmax is the greatest because the eccentricity is the greatest. FIG. 2C illustrates a moment the piston 7 is at a bottom dead center during a counter clockwise direction rotation, and FIG. 2D illustrates a moment the piston 7 is at a top dead center during a counter clockwise direction rotation, when the stroke Lmin is the smallest because the eccentricity is the smallest.

However, during the foregoing operation, the crank pin 3 and the eccentric ring 4 are involved in centrifugal forces, respectively caused by their rotation around the axis 1*a* of the crank shaft, exerting on an extension line between the shaft axis 1*a* and the pin axis 3*a*, and between the shaft axis 1*a* to the a center of gravity of the ring 4*a*, respectively. Therefore, different from FIGS. 2A and 2B, in cases of FIGS. 2C and 2D, as lines of actions are not on the same line, a local rotating moment is taken place at the eccentric ring 4 with respect to the pin 3 as a product of a vertical distance 'd' to the pin 3 and its own centrifugal force, acting in a direction the same with a direction (counter clockwise direction) of rotation of the crank shaft 1. Since the crank pin 3 and the eccentric ring 4 are members that can make relative motion to each other, the rotating moment causes a relative rotation of the eccentric ring 4 in a direction of rotation of the crank shaft 1, releasing the key 5 both from the crank pin 3 and the eccentric ring 4, and leaving the eccentric ring 4 and the key 5 to move in the rotation direction as shown in dashed lines in FIG. 3. Moreover, as shown in FIG. 3, for an example, during clockwise direction operation, a pressure 'P' (a pressure of re-expansion of the working fluid) in the cylinder after compression pushes the eccentric ring 4 to a direction of rotation of the crank shaft 1, to cause the eccentric ring 4 to make a relative rotation with respect to the crank pin 3 in a rotation direction of the crank shaft. At the end, such a relative rotation makes operation of the compressor unstable, to fail to obtain a desired compression performance.

In fact, the relative rotation is occurred because the key 5 fails to hold both the crank pin 3 and the eccentric ring, perfectly. The key 5 rolls within the release area whenever the direction of rotation of the crank shaft is changed, to cause serious wear at respective contact surfaces, that shortens a lifetime of the compressor.

In the meantime, other than the U.S. Pat. No. 4,236,874, there are many patent publications that disclose technologies of the dual capacity compressors, which will be described, briefly.

Similarly, U.S. Pat. No. 4,479,419 discloses a dual capacity compressor provided with a crank pin, eccentric cam and a key. The key is fixed to the eccentric cam, and moves along a track in a crank pin when a direction of rotation of the compressor is changed. However, since the key can not hold both the crank pin and the eccentric cam, perfectly, the U.S. Pat. No. 4,479,419 also has unstable operation caused by the relative rotation.

U.S. Pat. No. 5,951,261 discloses a compressor having an eccentric part with a diameter of bore formed across the eccentric part, and an eccentric cam with another bore with a diameter the same with the eccentric part formed at one side thereof. A pin is provided to the bore in the eccentric part, and a compression spring is provided to the bore in the eccentric sleeve. Accordingly, when the bores are aligned during rotation, the pin moves to the bore in the cam by a centrifugal force, that couple the eccentric part and the eccentric cam, together. However, since the U.S. Pat. No. 5,951,261 is provided with only one bore in the eccentric cam, the U.S. Pat. No. 5,951,261 can couple the eccentric part and the eccentric cam together only when the compressor rotates in a particular direction. Moreover, an operation reliability can not be secured, since an exact movement of the pin from the eccentric part to the cam through respective bores is difficult.

In the meantime, in all of the dual capacity compressors described before, the application of different additional members for changing the stroke distance cause to increase contacts and impacts between such members, to increase wear and noise coming from the contacts and the impacts.

SUMMARY OF THE INVENTION

Accordingly, the present invention is directed to a dual capacity compressor that substantially obviates one or more of the problems due to limitations and disadvantages of the related art.

An object of the present invention is to provide a dual capacity compressor which can maintain a constant eccentricity and make a stable operation even if the compressor is rotated in any directions that have different compression capacity.

Another object of the present invention is to provide a dual capacity compressor of which wear and noise are reduced.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

As described, the inventor understands that the unstable operation of the dual capacity compressor is caused by a local centrifugal force of the eccentric sleeve, and an external load through the connecting rod and etc., during operation. Though such causes are not avoidable as far as an eccentric mechanism is used, the inventor understand that, if the crank pin and the eccentric sleeve can be held positively during operation, such a problem can be solved. Taking an idea of a key member that has such a holding structure, the key member and members related thereto are modified to prevent the relative rotation between the crank pin and the eccentric sleeve.

Meanwhile, the inventor presumes that the addition of the eccentric sleeve and the key member will increase noise and wear, too. Therefore, for providing, not only a satisfactory compressor performance, but also a satisfactory reliability, related components are modified further for easing the contacts and impacts that are causes of the noise and the wear.

To achieve these and other advantages and in accordance with the purpose of the present invention, as embodied and broadly described, the dual capacity compressor includes a power generating part including a reversible motor and a crank shaft inserted in the motor, a compression part including a cylinder, a piston in the cylinder, and a connecting rod connected to the piston, a crank pin in an upper part of the crank shaft eccentric to an axis of the crank shaft, an eccentric sleeve having an inside circumferential surface rotatably fitted to an outside circumferential surface of the crank pin, and an outside circumferential surface rotatably fitted to an end of the connecting rod, a key member for coupling the eccentric sleeve with the crank pin positively in all rotation directions of the motor, and damping means for damping impact occurred between the eccentric sleeve and members adjoin thereto.

Preferably, the key member catches the eccentric sleeve at a plurality of points, and more preferably, the key member catches the eccentric sleeve at two points set up with reference to a center line in any direction during operation.

The parts will be described in more detail. At first, the crank pin includes one pair of key member fitting parts formed opposite to each other.

The eccentric sleeve includes a track part formed along a circumference thereof for enabling rotation of the eccentric sleeve itself relative to the projection of the key member, and a limiting part formed relative to the track part for limiting rotation of the projection of the key member. The track part of the eccentric sleeve is a cut away part cut along a circumferential direction at a depth from a top thereof, or a pass through hole extended along a circumferential direction to a length at a depth from the top thereof.

The steps formed between the track part and the limiting part is preferably parallel to an extension line connecting an axis of the crank shaft and an axis of the crank pin, and more preferably spaced apart from an extension line connecting the axis of the crank shaft and the axis of the crank pin as much as a distance equal to a half of a thickness of the key member.

The key member includes a first projection for projection for a length from the crank pin so as to be engaged with the step of the eccentric sleeve, a first stopper for limiting a projection length of the first projection, and a second projection for projection in a direction opposite to the first projection so as to be engaged with the other step in rotation.

Preferably, the key member further includes an elastic member inserted on the second projection for supporting the key member so that at least a part of the key member is kept projected out of the crank pin regardless of operation of the compressor. Preferably, the key member further includes a second stopper for limiting a length of projection of the second projection from the crank pin following the direction of action of the centrifugal force.

The damping means may include at least one groove for holding oil so as to be interposed between the eccentric sleeve and the members adjoin thereto. The groove is formed between the eccentric sleeve and the crank pin, in more detail, in an outside circumferential surface of the crank pin opposite to the eccentric sleeve.

Preferably, the groove is formed in a central part of the outside circumferential surface of the crank pin, or in an upper part and a lower part of the outside circumferential surface of the crank pin so as to opposite to an upper part and a lower part of the connecting rod fitted to the eccentric sleeve.

The damping means may include damping members attached to the eccentric sleeve and members adjoin thereto.

In one form of the damping member, the damping member is provided between the eccentric sleeve and the crank pin. In more detail, the damping member is fitted to an inside circumferential surface of the eccentric sleeve. Or, the damping member is fitted to the outside circumferential surface of the crank pin, preferably, fitted to the upper part and the lower part of the outside circumferential surface of the crank pin so as to opposite to the upper part and the lower part of the connecting rod fitted to the eccentric sleeve.

In other form of the damping member, the damping member is provided to the eccentric sleeve adjacent to the connecting rod, and preferably, the damping member is provided to a top of the outside circumferential surface of the eccentric sleeve.

In another form of the damping member, the damping member is provided to a position between the eccentric sleeve and a balance weight of the crank shaft positioned under the eccentric sleeve. The damping member is fitted on a top surface of the balance weight to support the eccentric sleeve, preferably, the damping member is designed to support the eccentric sleeve to be in close contact with the key member.

In further form of the damping member, the damping member is provided to the key member, and preferably the damping member is fitted to an outside circumferential surface of the key member.

The present invention prevents relative rotation between the crank pin and the eccentric sleeve, permitting stable operation and efficiency improvement of the compressor. Along with this, the contact and hitting between the eccentric sleeve and member adjoin thereto are dampened, to prevent noise and wear.

It is to be understood that both the foregoing general description and the following detailed description are exemplary and explanatory and are intended to provide further description of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In describing embodiments of the present invention, same parts will be given the same names and reference symbols, and repetitive descriptions of which will be omitted. An overall structure of the dual capacity compressor of the present invention will be described, with reference to FIG. 4.

Figure 1:
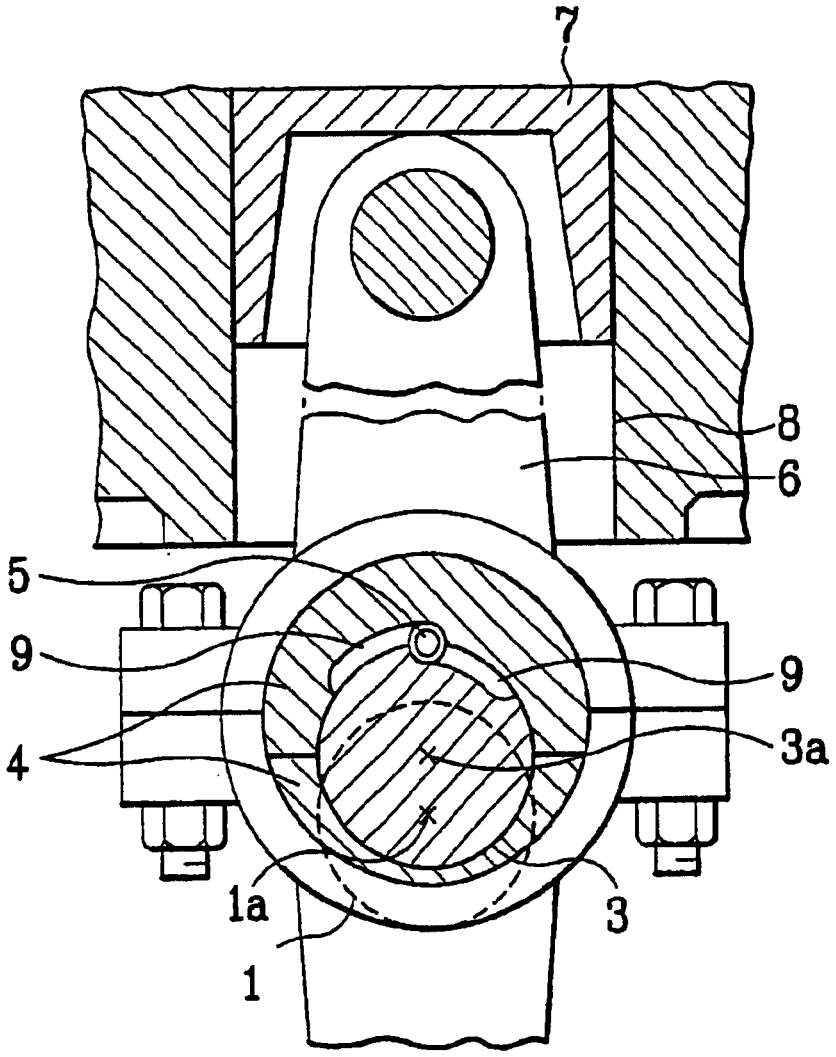
PRIOR ART FIG. 1
FIG. 1 illustrates a section of a related art dual capacity compressor.
Figure 2:
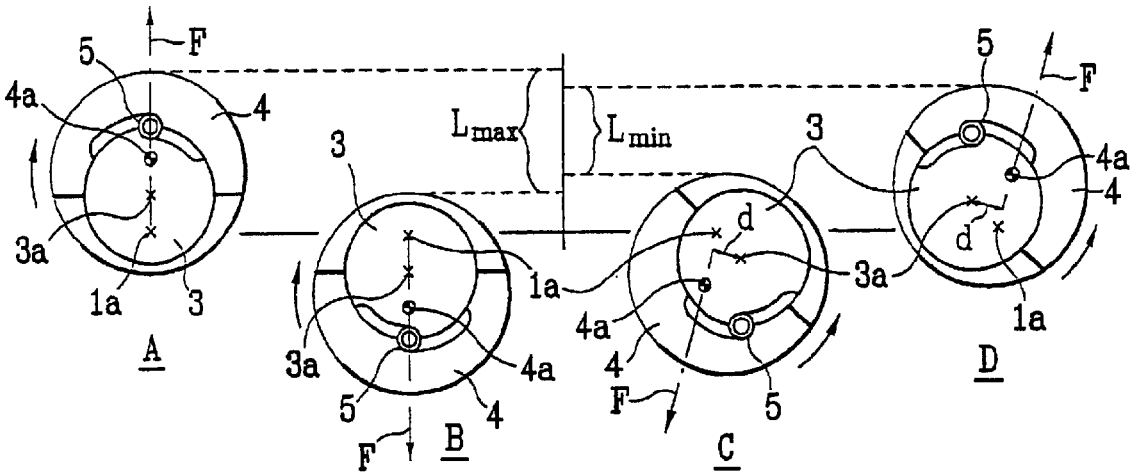
PRIOR ART FIG. 2
FIG. 2 illustrates the operation of the related art dual capacity compressor in FIG. 1, schematically.
Figure 3:
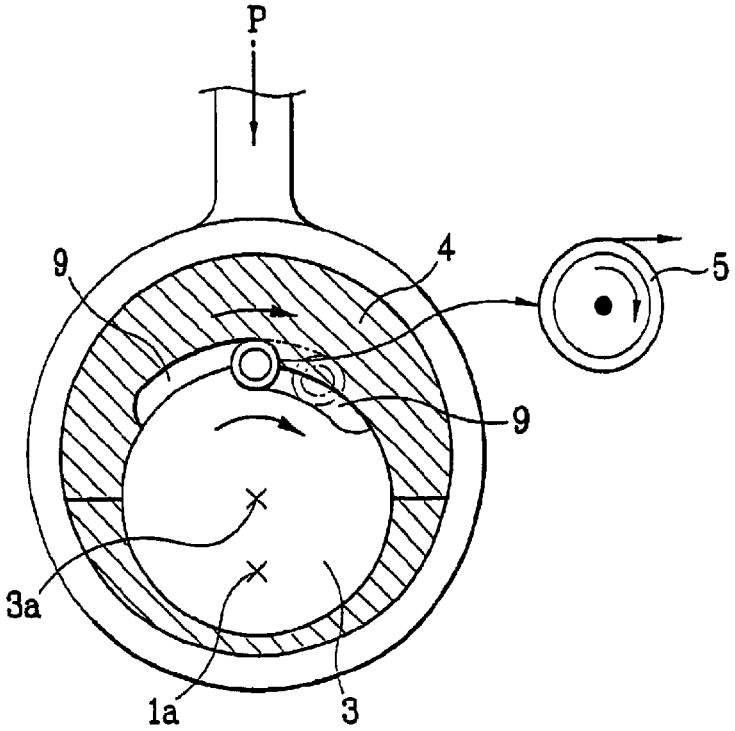
PRIOR ART FIG. 3
FIG. 3 illustrates a section of key parts of a related art dual capacity compressor showing relative rotation between the crank pin and the eccentric sleeve, schematically.
Figure 4:
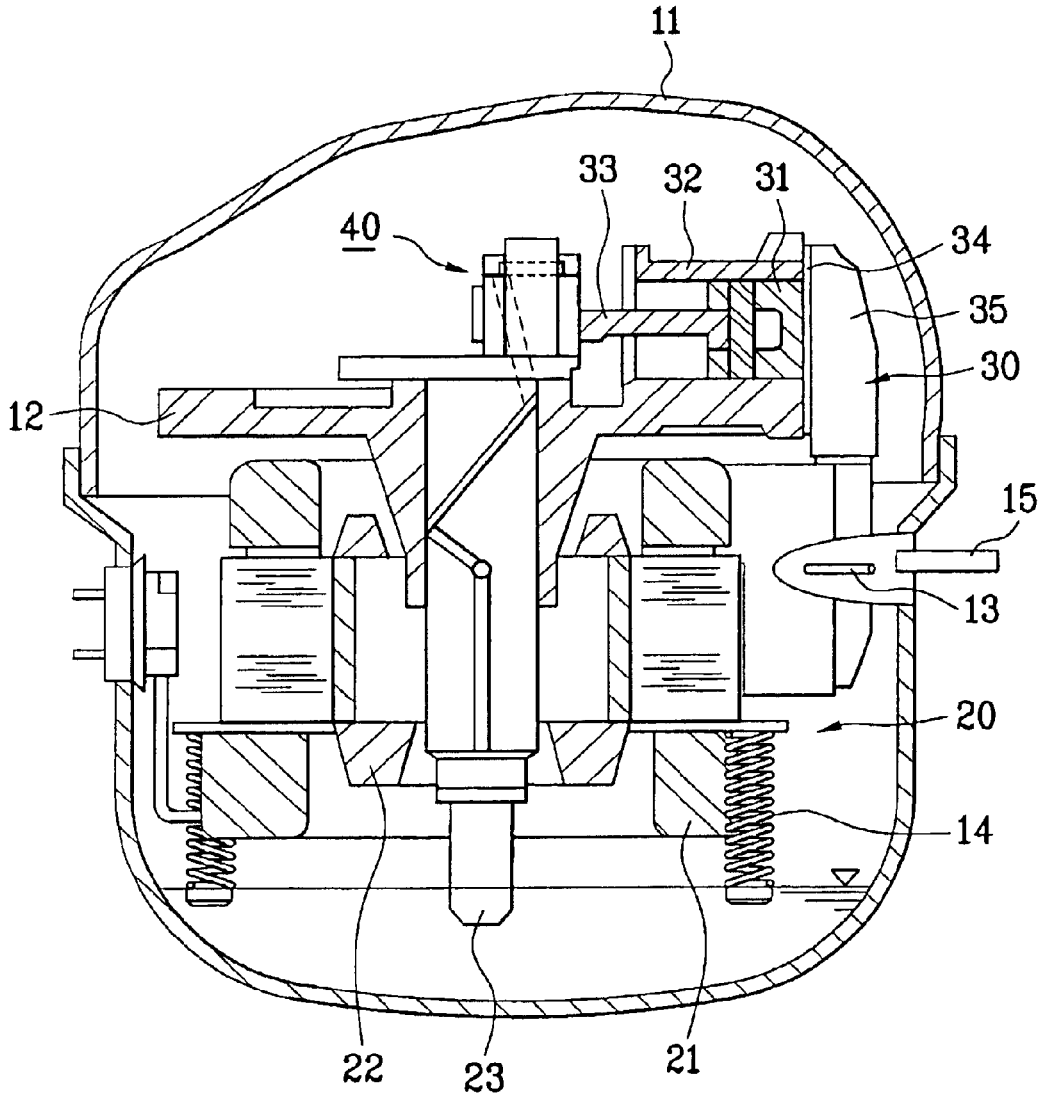
FIG. 4 illustrates a section of a dual capacity compressor in accordance with a preferred embodiment of the present invention.

Referring to FIG. 4, the dual capacity compressor of the present invention includes a power generating part 20 in a lower portion of the compressor for generating and transmitting a required power, and a compression part 30 over the power generating part 20 for compressing working fluid by using the power. Moreover, in addition to these general parts, the dual capacity compressor includes a stroke changing part 40 connected between the power generating part 20 and the compression part 30 for varying a compression capacity of the compression part 30 during operation. In the meantime, there is a shell which encloses the power generating part 20 and the compression part 30 for preventing refrigerant from leaking, and there is a frame 12 elastically supported on a plurality of supporting members (i.e., springs) attached to an inside of the shell. There are a refrigerant inlet 13 and a refrigerant outlet 15 fitted to, and in communication with an inside of the shell.

The power generating part 20 under the frame 12 includes a motor with a stator 21 and rotator 22 for generating a rotating force by an external electrical power, and a crank shaft 23. The motor is reversible. The crank shaft 23 has a lower part inserted in the rotator 22 for transmission of a power, and oil holes or grooves for supplying lubrication oil held in the lower part to driving parts.

The compression part 30 is mounted on the frame 12 over the power generating part 20, and includes a mechanical driving part for compression of the refrigerant, and a suction and discharge valves for assisting the driving part. In addition to a cylinder 32 that actually forms a compression space, the driving part has a piston 31 for reciprocating in the cylinder 32, and a connecting rod 33 for transmission of reciprocating power to the piston 31. The valves receive and discharge refrigerant to/from the cylinder 32 in association with a cylinder head 34 and the head cover 35.

The stroke changing part 40 of the dual capacity compressor of the present invention will be described in detail, while description of the power generating part and the compression part, which are identical to the related art, are omitted.

Figure 5A:
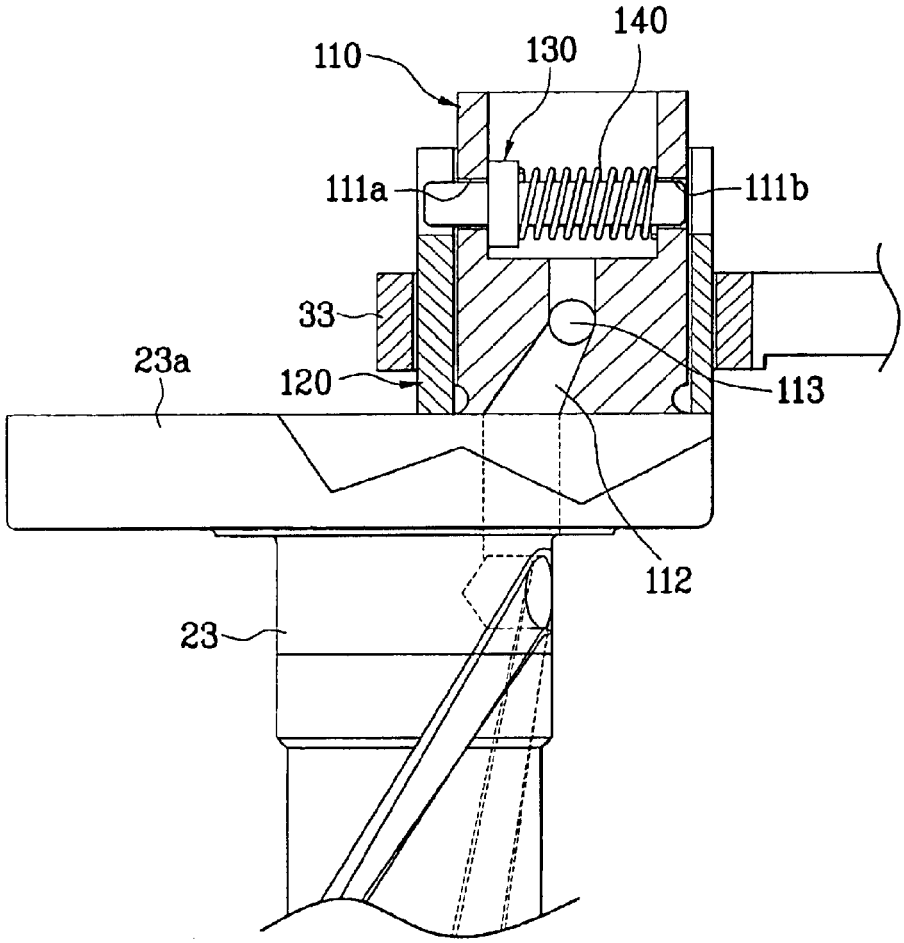
FIG. 5A illustrates a side view with a partial section of a dual capacity compressor in accordance with a first preferred embodiment of the present invention.

Referring to FIG. 5A, on the whole, the stroke changing part 40 includes a crank pin 110 on top of, and in eccentric to, the crank shaft, an eccentric sleeve 120 rotatably fitted between an outside circumferential surface of the crank pin 110 and the connecting rod 33, and a key member 130 fitted in the crank pin 110. The key member 130 holds the positions of the crank pin 110 and the eccentric sleeve 120 with respect to each other during operation of the compressor. In the stroke changing part 40, the eccentric sleeve 120 is arranged while being rotated between the connecting rod 33 and the crank pin 110, so that an effective eccentricity thereof varies with a rotation direction (regular or reverse direction) of the motor. For maintaining such a varied effective eccentricity, the key member 130 is caught at the eccentric sleeve 120. Therefore, in the stroke changing part 40, when the rotation direction of the motor is changed, a stroke length of the connecting rod and a displacement of the piston vary with variation of the effective eccentricity, and thus the compression capacity also changes depending on the rotation direction. The stroke changing part 40 of the present invention described briefly will be described in more detail, with reference to the attached drawings.

Figure 5B:
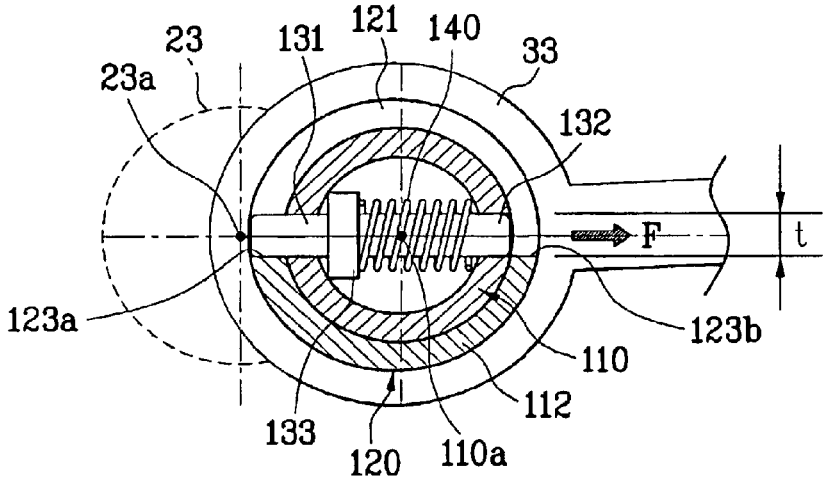
FIG. 5B illustrates a plan view with a partial section of a dual capacity compressor in accordance with a first preferred embodiment of the present invention.

FIGS. 5A and 5B illustrate side and plan views of dual capacity compressors of the present invention respectively, wherein components thereof are shown in assembled states with partial sections for easy description and clarity. FIGS. 6A~12 illustrate the components, individually.

Referring to FIG. 5A, the crank pin 110 is hollow partially, for movable fitting of the key member 130 in the hollow. The crank pin 110 also has one pair of key member fitting parts 111 formed opposite to each other, and an oil passage 112 and an oil supply hole 113 in a low part.

Figure 6A:
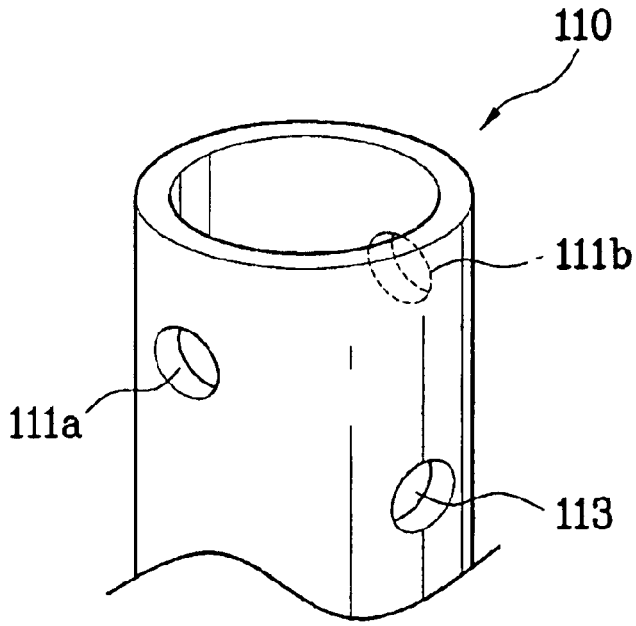
FIG. 6A illustrates a perspective view of a crank pin in accordance with a first preferred embodiment of the present invention.
Figure 6B:
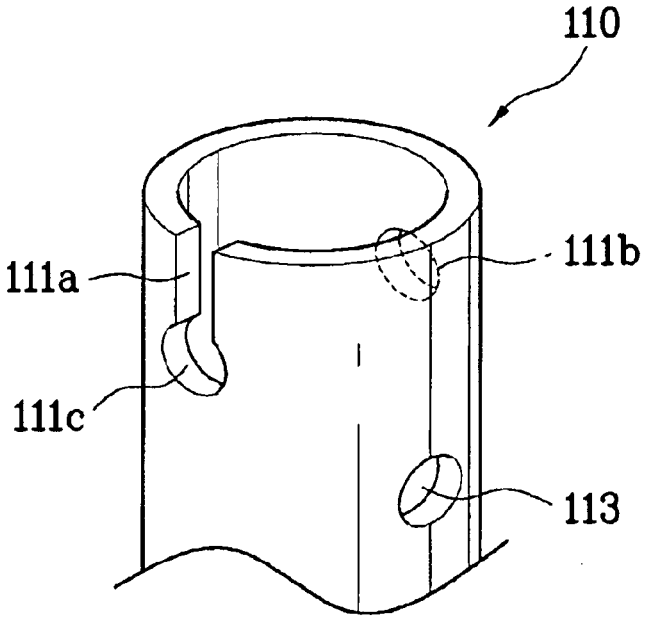
FIG. 6B illustrates a perspective view of a crank pin modified from one in FIG. 6A.

Referring to FIGS. 5A and 5B, the fitting parts 111*a* and 111*b* are formed in the hollow tube part so as to be disposed in a vertical plane containing the crank shaft axis 23*a* and the crank pin axis 110*a*. Accordingly, the key member 130 in the fitting parts 111*a* and 111*b* are influenced from a centrifugal force F exerting on the extension line between the axes 23*a* and 110*a* along a longitudinal direction of the key member 130. The key member 130 is movable by the centrifugal force F guided by the fitting parts 111*a* and 111*b*. As shown in FIG. 6A, the fitting parts 111*a* and 111*b* may actually form a pass through hole. The fitting parts 111 of the pass through hole can prevent the key member 130 from falling off during operation. Preferably, as shown in FIG. 6B, at least one of the fitting parts 111*a* and 111*b* may be a slot extended from a top end of a wall of the crank pin 110 to a position, for easy fitting of the key member 130 to the crank pin 110. It is more preferable that there is a seat part 111*c* at an end of the fitting part for stable fitting of the key member 130.

Referring to FIG. 5A, the oil passage 112 is in communication both with the oil groove in outside surface of the crank shaft 23, and the oil supply hole 113. The oil supply hole 113 is formed along a line perpendicular to an extension line connecting the fitting parts 111*a* and 111*b*. The lubrication oil on the bottom of the compressor is at first passed through the oil groove and the oil passage 112, and sprayed so as to be supplied between contact surfaces of the components during operation for prevention of wear and smooth operation of the components, and may be supplied to a gap between the crank pin 110 and the eccentric sleeve 120 directly through the oil supply hole 113. Preferably, the crank pin 110 is formed higher than the eccentric sleeve 120, for spraying the lubrication oil to the components evenly from a high position.

The eccentric sleeve 120 basically has an inside circumferential surface rotatably coupled to an outside circumferential surface of the crank pin 110, and an outside circumferential surface rotatably coupled to an end of the connecting rod 33. In more detail, as shown in 7A, the eccentric sleeve 120 includes a track part 121 formed along a circumference thereof, and a limiting part 122 for limiting a track of the track part 121. There are two steps 123*a* and 123*b* between the track part 121 and the limiting part 122. As shown in FIG. 5A, since at least a part of the key member 130 is projected so as to be caught at the eccentric sleeve 120 when the compressor is not in operation, the track part 121 makes such a rotation of the eccentric sleeve 120 itself relative to the key member possible. That is, the eccentric sleeve 120 can rotate round the crank pin 110 as much as a range the track part 120 is formed therein. Opposite to the track part 121, the limiting part 122 limits rotation of the sleeve itself together with the key member 130 during stoppage and movement. Actually, the key member 130 is caught at the steps 123*a* and 123*b*.

Figure 7A:
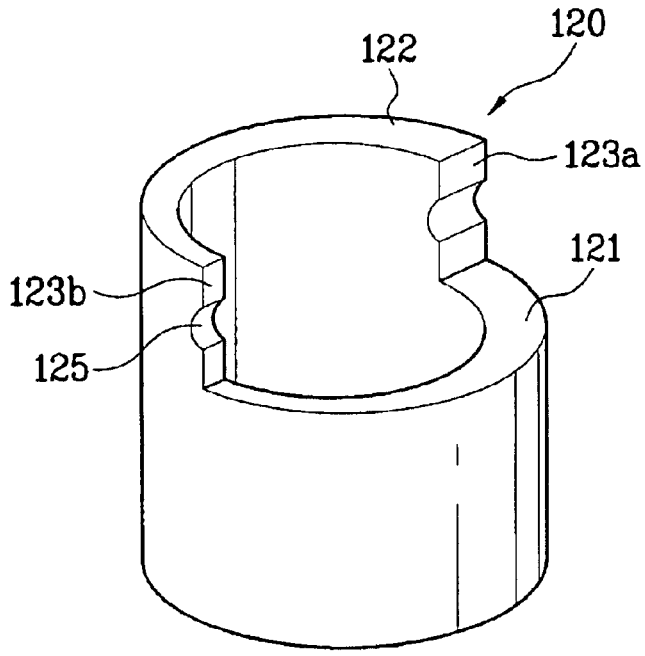
FIG. 7A illustrates a perspective view of an eccentric sleeve of the present invention.
Figure 7B:
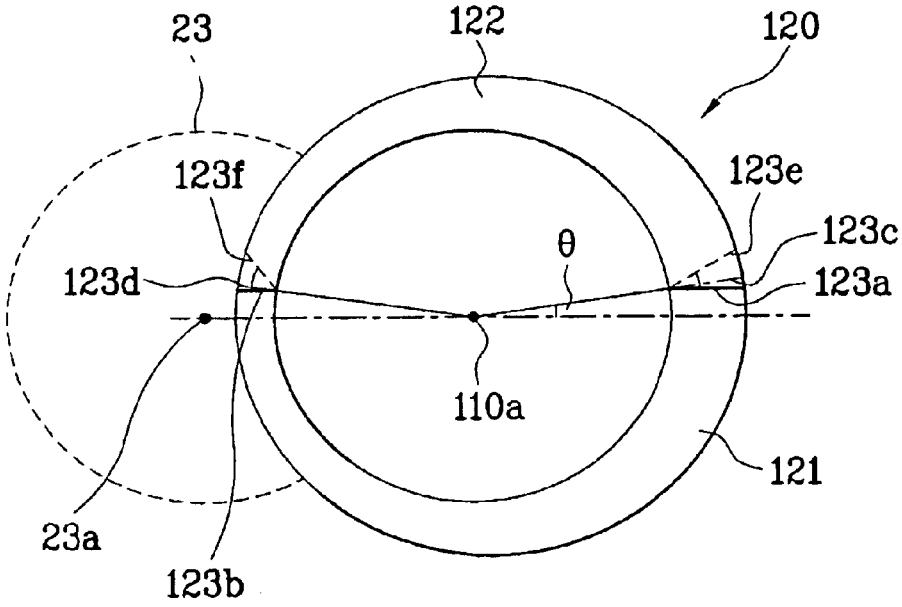
FIGS. 7B, 7C, and 7D illustrate a plan view, a side view, and a perspective view of variations of eccentric sleeves of the present invention, respectively.

In the eccentric sleeve 120, the track part 121 may be a cut away part cut along a circumference direction starting from a top end of the eccentric sleeve 120 to a required depth, actually. As shown in FIGS. 5B and 7B, the steps 123*a* and 123*b* are formed in parallel to an extension line between the crank shaft axis 23*a* and the crank pin axis 10*a*. That is, the steps 123*a* and 123*b* are actually formed in parallel to an extension line between a maximum thickness and a minimum thickness of the eccentric sleeve to have different widths, and the extension line is on the extension line between the axes 23*a* and 110*a* during operation of the compressor. In other words, the steps 123*a* and 123*b* are positioned on an extension line parallel to the extension line of the axes 23*a* and 110*a* at the same time. Consequently, the key member 130 disposed on the same extension line can be caught at both of the steps 123*a* and 123*b*, such that the steps 123*a* and 123*b* form common contact surfaces for the key member 130, actually. Preferably, the steps 123*a* and 123*b* are spaced away from the extension line between the axes 23*a* and 110*a* by a half of a thickness 't' of the key member 130. According to this, the key member 130 can be caught at the steps 123*a* and 123*b* more stably and accurately. On the other hand, the steps 123*a* and 123*b* may be formed to have slopes respectively each at an angle with respect to the extension line between the axes 23*a* and 110*a*. In more detail, the steps 123*c* and 123*d* may be formed in a radial direction extension line from the crank pin axis 110*a* sloped at an angle θ with respect to the extension line between the axes 23*a* and 110*a*. Also, the steps 123*e* and 123*f* may be further sloped at an angle toward the limiting part about a cross point with an inner circumference of the crank pin 110. Even in above cases, the steps 123*c*, 123*d*, 123*e* and 123*f* have at least common contact point with the key member 130, for engagement with each other. Moreover, the track part 121 may be, not only the cut away part as shown in FIG. 7A, but also a pass through hole extended to a length along a circumferential direction at a depth from the top end of the sleeve 120 as shown in FIG. 7D. The track part 121 of such a pass through hole holds the key member 130 so as not to break away in a vertical direction.

Figure 7C:
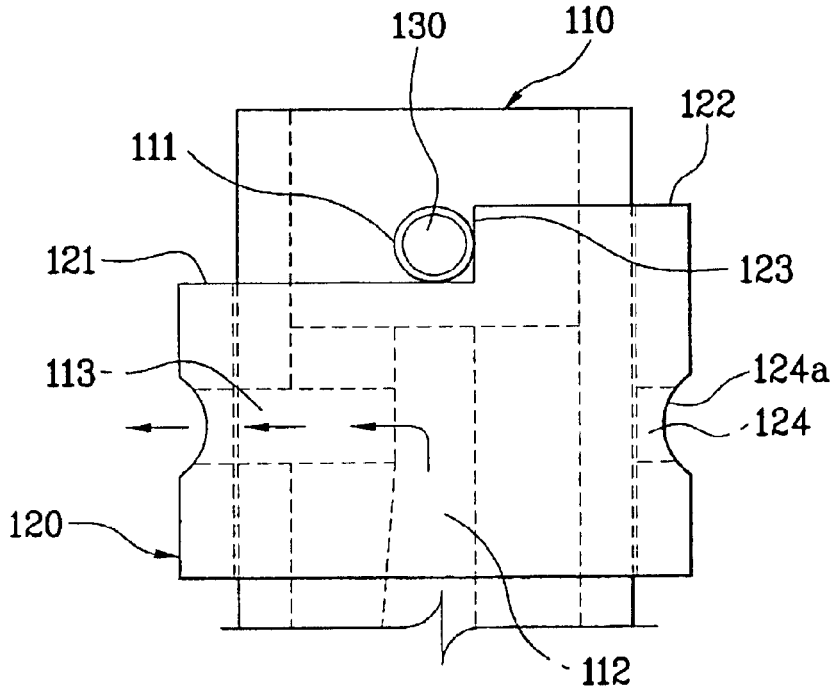
Figure 7D:
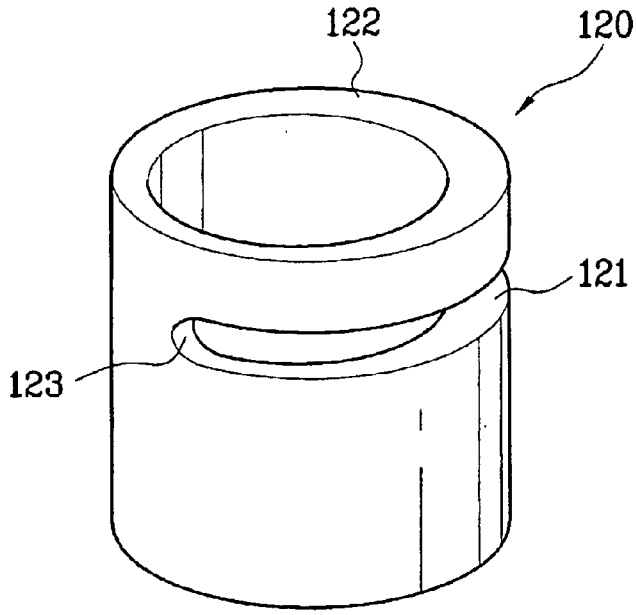

Other than this, referring to FIG. 7C, the eccentric sleeve 120 may further include oil supply holes 124 formed oppositely at a height. The oil supply holes 124 may be through holes formed symmetry with respect to the extension line between the axes 23*a* and 110*a*, such that the oil supply hole 124 is in communication with the oil supply hole 113 in the crank pin when the key member 130 is caught at the eccentric sleeve 110. Therefore, during operation of the compressor, one of the two oil supply holes 124 is in communication with the oil supply hole 113 regardless of the direction of rotation, allowing the lubrication oil supplied to the eccentric sleeve 120 and the connecting rod 33. In addition to this, an oil groove 124*a* is formed around the oil supply hole 124 to a depth, for forming a space for distributing the oil around the oil supply hole 124, thereby making supply of lubrication oil between the eccentric sleeve 120 and the connecting rod 33 easy. Referring to FIG. 7A again, the eccentric sleeve 120 may further include a seat 125 in each of the steps 123*a* and 123*b*. The steps 125 receive the key member 130 when the key member 130 is caught at the eccentric sleeve 110. The seat 125 may be a groove in the step 123*a* or 123*b* actually, and it is preferable that a section of the key member 130 is fit a section of the part in contact with the step 123. According to this, owing to the seats 125, the key member 130 can be caught at the eccentric sleeve 120, stably. Moreover, owing to the seats 125, the key member 130 can make, not point to point contact, but surface to surface contact with the eccentric sleeve 120. Therefore, even if the key member 130 and the eccentric sleeve 120 are brought into repetitive contact during operation of the compressor, neither the key member 130, nor the eccentric sleeve 120, is not broken due to stress concentration and fatigue caused thereby.

Figure 8:
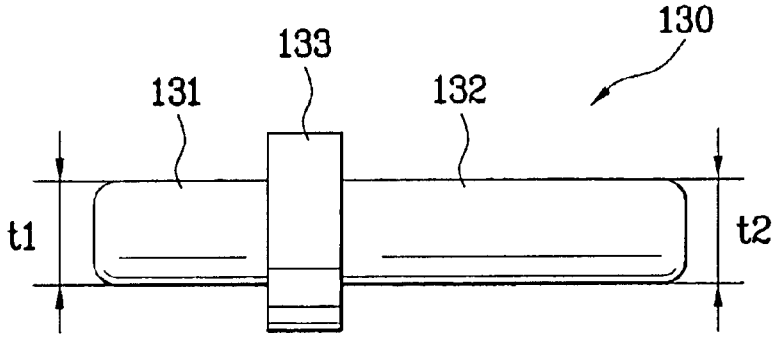
FIG. 8 illustrates a perspective view of a key member of the present invention.

FIGS. 5A, 5B, and 8 illustrate the key member 130 in detail, respectively. As shown, basically the key member 130 includes a first projection 131 to be projected for a length from the crank pin 110 even when the compressor is not in operation, and a second projection 132 to be projected for a length from the crank pin 110 when the compressor is in operation. The key member 130 also includes a first stopper 133 for limiting a projection length of the first projection 131. Together with this, the key member 130 includes an elastic member 140 for regulating a position of the key member 130 during the compressor is stopped or in operation. In the present invention, the key member 130 holds the eccentric sleeve 120 while the key member 130 is moved by the centrifugal force. Especially, as described before, the second projection 132 holds the eccentric sleeve 120 as the second projection 132 is projected during operation. For being projected by the centrifugal force generated during operation, it is required that the second projection 132 is directed to the same direction with a direction of the centrifugal force. Therefore, as shown, while the second projection 132 is positioned at outer sides of radii of the crank shaft 23 and the crank pin 110 relatively, the first projection 131 is positioned at inner sides of radii of the crank shaft 23 and the crank pin 110. In other words, actually, the second projection 132 is arranged in the crank pin 110 spaced away from the axis 22*a* of the crank shaft for receiving a great centrifugal force, and relative to this, the first projection 131 is arranged adjacent to the center 22*a*. Moreover, in order to catch the eccentric sleeve 120 at the same time, it is preferable that the key member 130 has a length greater than an outside diameter of the crank pin 110 during operation of the compressor.

In more detail, referring to FIG. 5A, the first projection 131 is projected from the crank pin 110 and engaged with one of the steps 123*a* and 123*b* regardless of operation state (stop or in operation) of the compressor, and maintains an engaged state even during operation of the compressor. For this, the elastic member 140 is fitted on the second projection 132 and supports the first stopper 133 elastically, together with an inside wall of the crank pin 110. A length of the projection of the first projection is limited as the first stopper 133 of the key member 130 interferes with the inside wall of the crank pin 110. For more stable operation, it is preferable that the length of the first projection is at least a half of a minimum width of the steps 123*a* and 123*b*. Also, as described before, the first projection 131 is positioned at an inner side in a radial direction of the crank shaft 23 and the crank pin 110, the first projection 131 is projected toward the inner side in the radial direction, i.e., the axis 23*a* of the crank shaft, continuously. Therefore, the key member 130 is caught at at least a part of the eccentric sleeve 120 relatively positioned at the inner side of radial direction of the crank shaft 23.

The second projection is projected in a direction opposite to the first projection, to engage with the other step during operation. According to this, the first and second projections 131 and 132 of the key member 130 engage with the eccentric sleeve 120 at the same time. The centrifugal force along the key member 130 becomes the greater gradually as the rotation speed of the crank shaft 23 becomes the faster to overcome the elastic force of the elastic member 140. According to this, the second projection is moved and projected in a direction of the centrifugal force (i.e., in a direction of an extension line between the axes 23*a* and 11*a*). In this instance, the eccentric sleeve 120 rotates round the crank pin 110 for changing eccentricity when the compressor changes a direction of rotation. Therefore, in order not to interfere the rotation of the eccentric sleeve 120, it is required that the second projection 132 has a length a tip of which does not project beyond an outside circumference of the crank pin 110 when the compressor is not in operation.

The first and second projections 131 and 132 are engaged with the steps 123*a* and 123*b* alternately depending on the rotation direction of the crank shaft. Since the key member 130 is arranged on the extension line between the axes 23*a* and 110*a* or at least parallel thereto, respective contact positions of the key member 130 to the steps 123*a* and 123*b* differ if thickness 't1' and 't2' of the first and second projections differ. Therefore, the thickness 't1' and 't2' of the first and second projections 131 and 132 are required to have the same thickness for accurate engagement with the steps 123*a* and 123*b*. Though a section of the key member 130 is circular in the drawing and description of the present invention, any form of the section, such as square or hexagonal, that can make engagement with the steps 123*a* and 123*b*, may be used.

Figure 9:
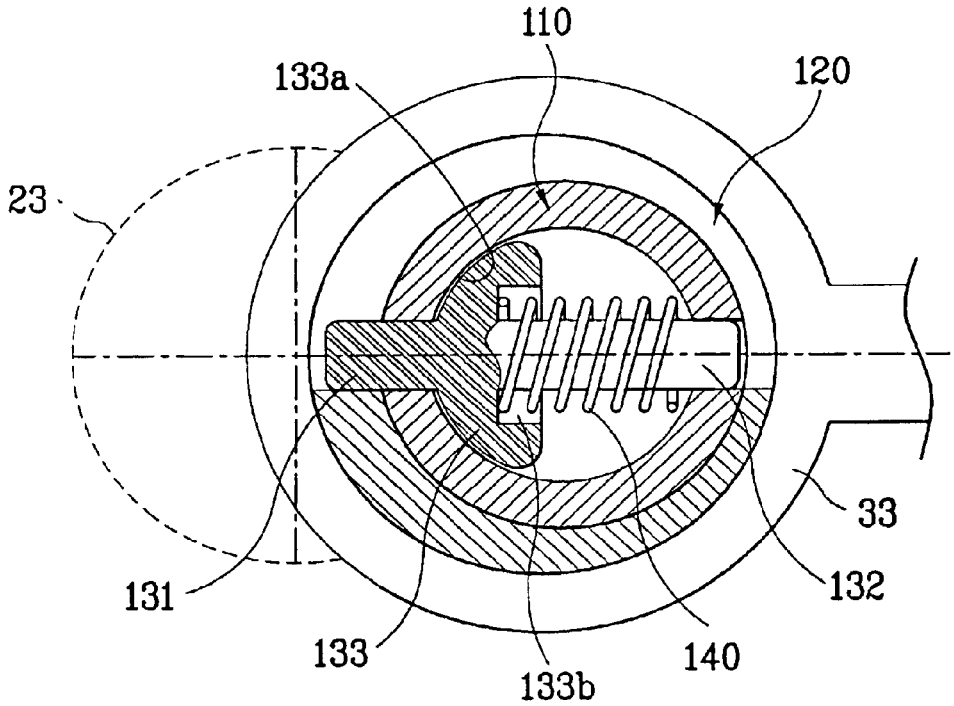
FIG. 9 illustrates a plan view of a variation of the key member to a crank pin in FIG. 8.

Referring to FIG. 9, a contact surface 133*a* of the first stopper 133 may have a form fit to an inside circumferential surface of the crank pin 100. According to this, the key member 130 can be engaged with the crank pin 110 exactly, and can make more smooth operation owing to an increased weight thereof (i.e., an increased centrifugal force makes an easy projection of the second projection 132). Preferably, the first stopper 133 may further include a recess 133*b* for making stable reception of the elastic member 140. Such contact surface 133*a* and the recess 133*b* supplement stable operation of the key member 230, actually. In the meantime, the first stopper 133 may be formed as a unit with the key member 130, or separately to be fitted to the key member 130. Examples of such separate type first stopper 133 are shown in FIGS. 10A and 10B.

Figure 10A:
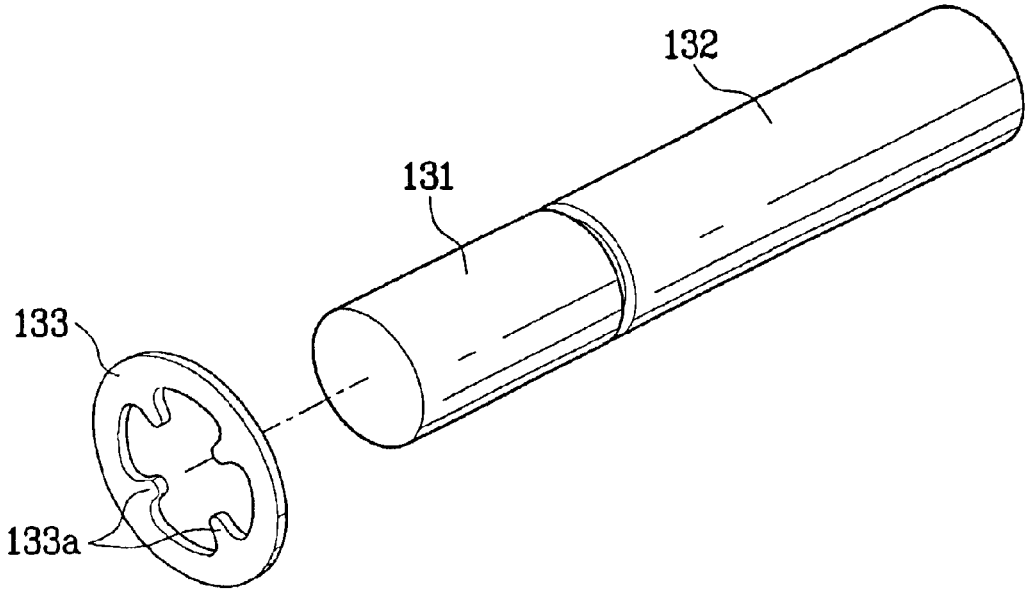
FIGS. 10A and 10B illustrate perspective views of variations of key members each having a detachable first stopper.
Figure 10B:
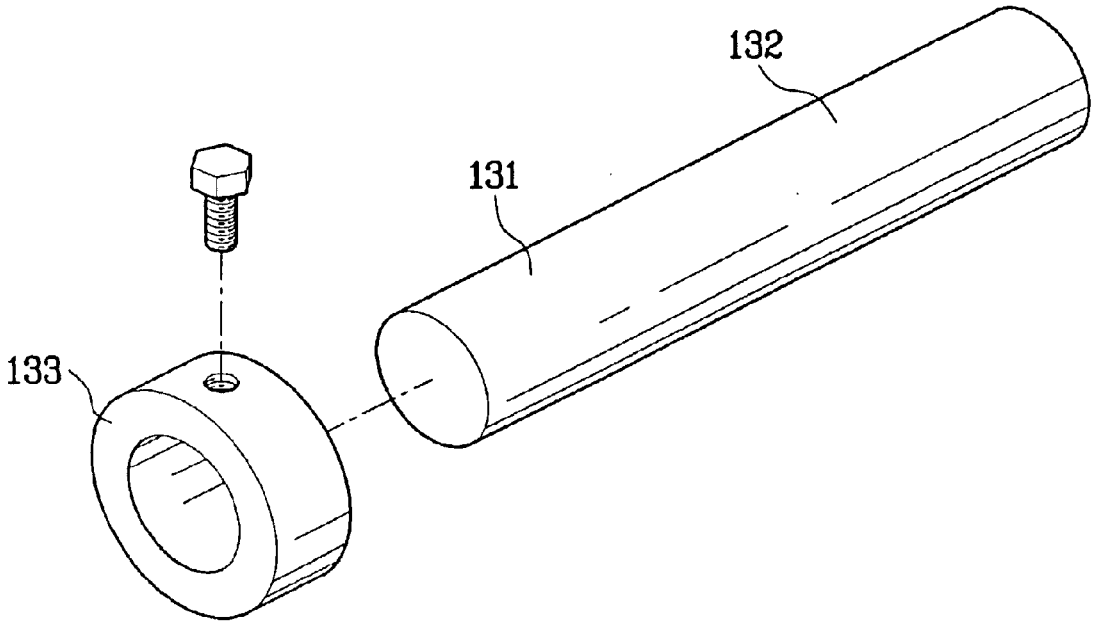

Referring to FIG. 10A, the first stopper 133 may include projections 133*a* extended inward in a radial direction. According to this, the first stopper 133 is fitted to the key member 130 as the projections 133*a* are inserted in a circumferential groove in a position of the key member 130. Or, as shown in FIG. 10B, the first stopper 133 of a simple ring member may be fastened to a position of the key member 130 with a fastening member. These separate type stoppers 133 enable fitting of the key member 130 to the crank pin 130 even when both of the key member fitting parts 111*a* and 111*b* are through holes. In more detail, by placing the stopper 133 on an inside of the crank pin 110, and inserting the key member 130 through the through holes, the stopper 133 and the key member 130 are joined.

In the meantime, as described before, in the key member 130, the projection length of the second projection 132 in the key member 130 can be regulated by the elastic force of the elastic member 140 during regular operation. However, the transient sharp acceleration of the crank shaft 23 and the crank pin 110 at starting of the compressor causes a substantially great momentary centrifugal force exerted on the key member 130. It is liable that the second projection 132 is projected excessively by the centrifugal force enough to cause the first projection 131 broken away from the fitting part 111. Therefore, it is preferable that the key member 130 further includes a second stopper 134 for limiting the projection length of the second projection 133 beyond the crank pin 110 by the centrifugal force.

Figure 11A:
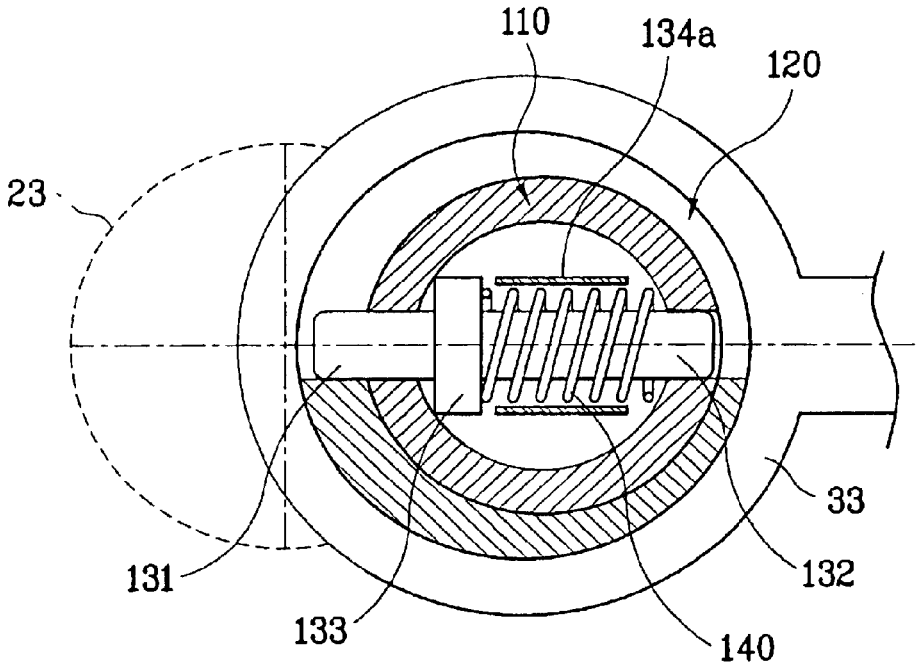
FIGS. 11A~11C illustrate plan views of variations of key members each having a second stopper.
Figure 11B:
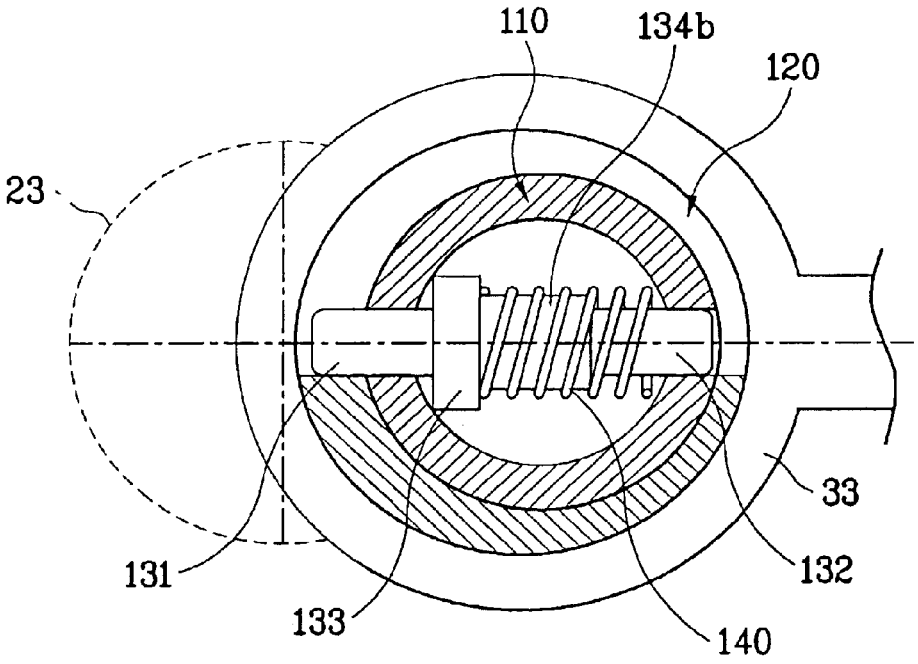
Figure 11C:
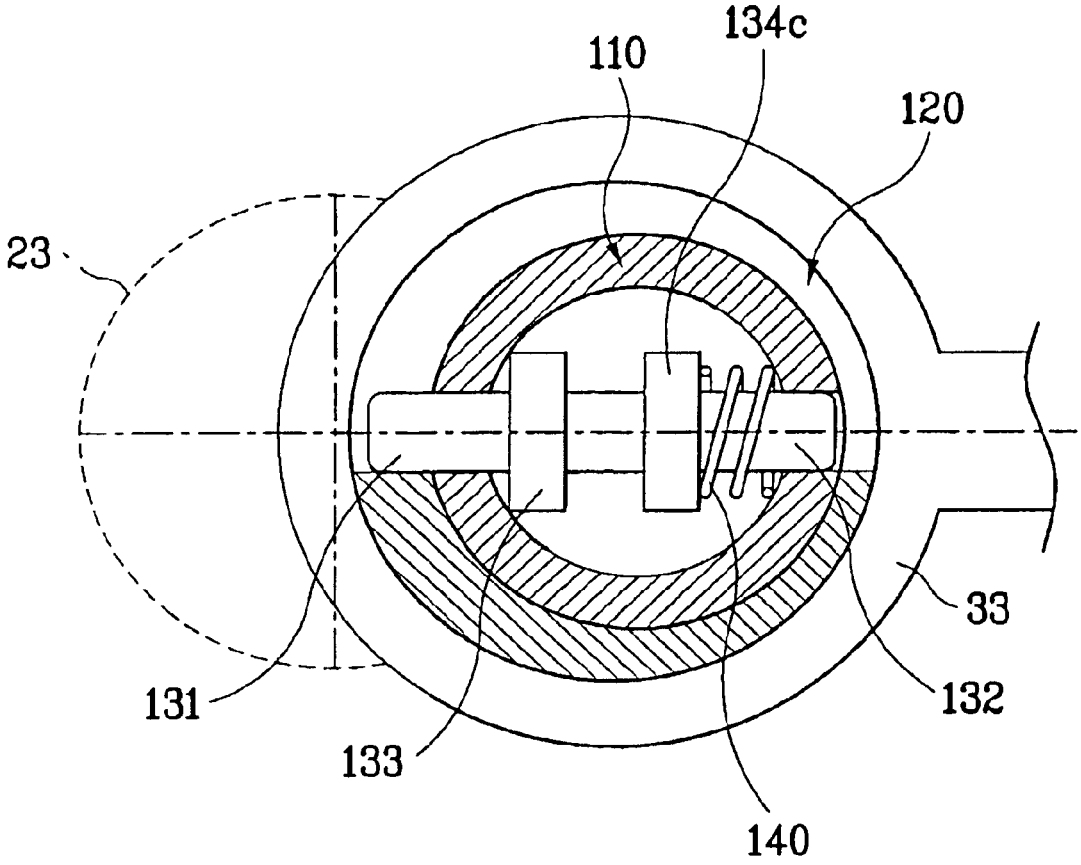

Referring to FIG. 11A, the second stopper 134 may be a hollow tube member 134*a* movably fitted on the second projection 132 in a length direction of the second projection 132. In this instance, the elastic member 140 is arranged between the second stopper 134*a* and the second projection 132. The second stopper 134*a* comes into contact both with the first stopper 133 and an inside wall of the crank pin 110 when the key member 130 moves in a direction of the centrifugal force, thereby preventing the second projection 133 from being projected more than a certain length. As shown in FIG. 11B, the second stopper 134 may be an extension 134*b* having a thickness at least greater than a thickness of the second projection 133. That is, the second stopper 134*b* in FIG. 11B is a lengthwise extension of the first stopper 133, actually. In this case, the elastic member 140 is fitted on an outside circumference of the second stopper 134*b*. Or, as shown in FIG. 11C, the second stopper 134 may be a radial direction extension 134*c* of the second projection to a required thickness, having a form similar to the first stopper 133, actually. In this case, the elastic member 140 is fitted between the second stopper 134*b* and the inside circumferential surface of the crank pin 110. Similar to variations to the first stopper 133 described with reference to FIGS. 10A and 10B, the stoppers 134*b* and 134*c* may be separate members fixed to the key member 130, respectively.

In summary, basically the key member 130 has a length greater than a diameter of the crank pin by at least a predetermined amount, and is movably fitted in the crank pin. At least a part of the key member 130 (i.e., the first projection) is projected from the crank pin even if the compressor is not in operation, and the other part thereof (the second projection) is projected from the crank pin 110 by the centrifugal force during the compressor is in operation. That is, the key member 130 is caught at least at a part of the eccentric sleeve 120 continuously, and caught at the eccentric sleeve 120 additionally when the compressor is in operation. Therefore, the key member 130 is substantially in contact with the eccentric sleeve 120 at a plurality of points, and more particularly, during the operation of the compressor, the key member 130 is in contact with both of opposite ends of the eccentric member 120 set up with reference to an arbitrary center line thereof in a horizontal plane. Eventually, the key member 130 makes the eccentric sleeve 120 coupled with the rotating crank pin 110 positively in any direction rotation of the motor, thereby preventing the eccentric sleeve 120 and the crank pin 110 from moving relative to each other.

In the meantime, as described before, since additional members, i.e., the eccentric sleeve 120 and the key member 130, are fitted between the connecting rod 33 and the crank pin 110 for changing the compression stroke, contact surfaces between respective members increase in the compressor (more specifically, the stroke changing part 40). Also, the compressor is fast, it is liable that a heavy dynamic load is applied to the members 33, 110, 120, and 130 momentarily, to cause hits and impacts between the members. Such contacts and impacts cause wear and noise of the members, and, particularly, since the eccentric sleeve 120 are in contact with all the other members 33, 110, and 130, the eccentric sleeve 120 may be involved in intensive wear and noise. Therefore, in the present invention, for easing the contacts and the impacts, damping means is applied between the eccentric sleeve 120 and adjoining members 33, 110, and 130.

Figure 12:
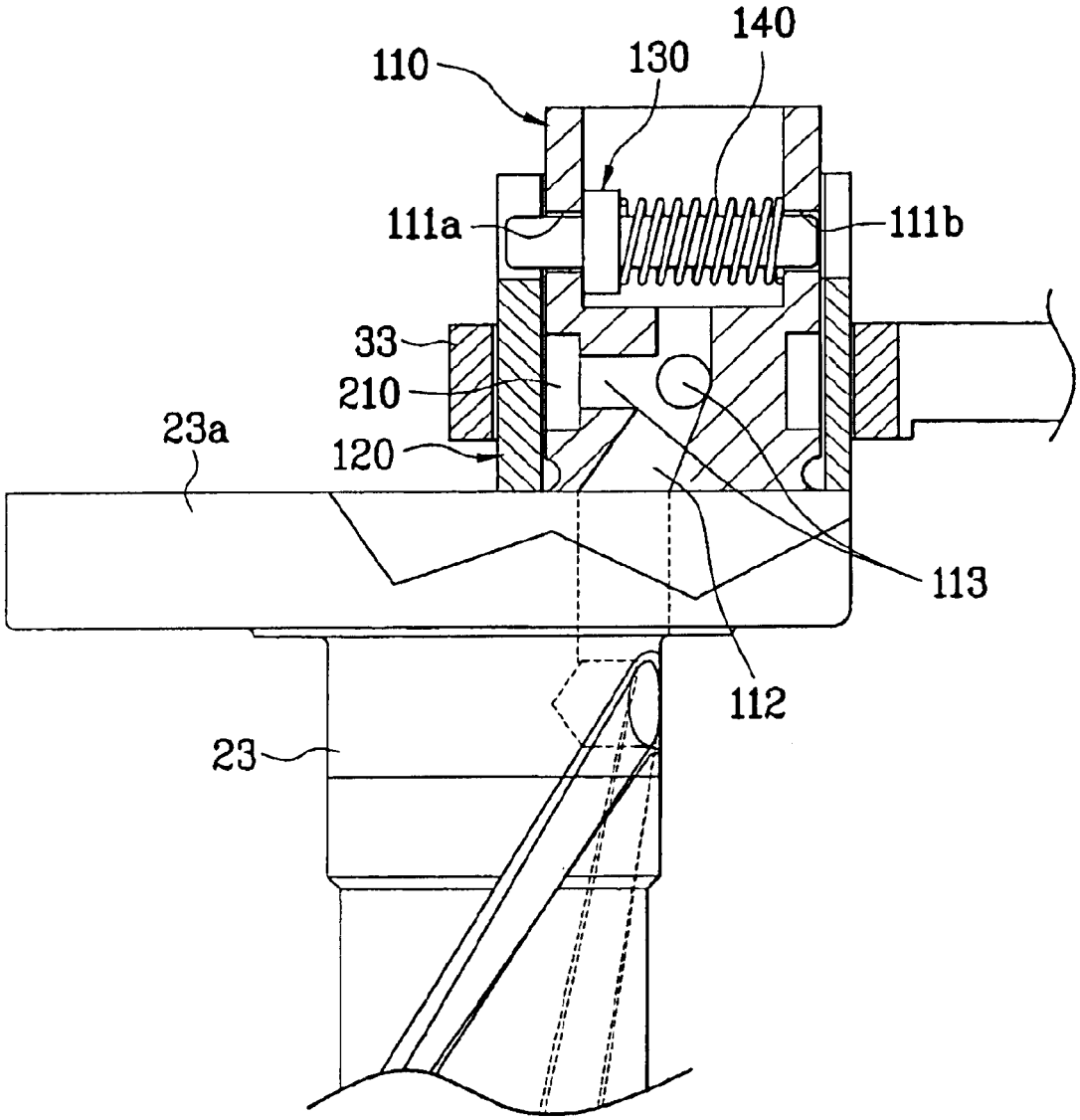
FIG. 12 illustrates a side view of an oil groove in a dual capacity compressor of the present invention.
Figure 13A:
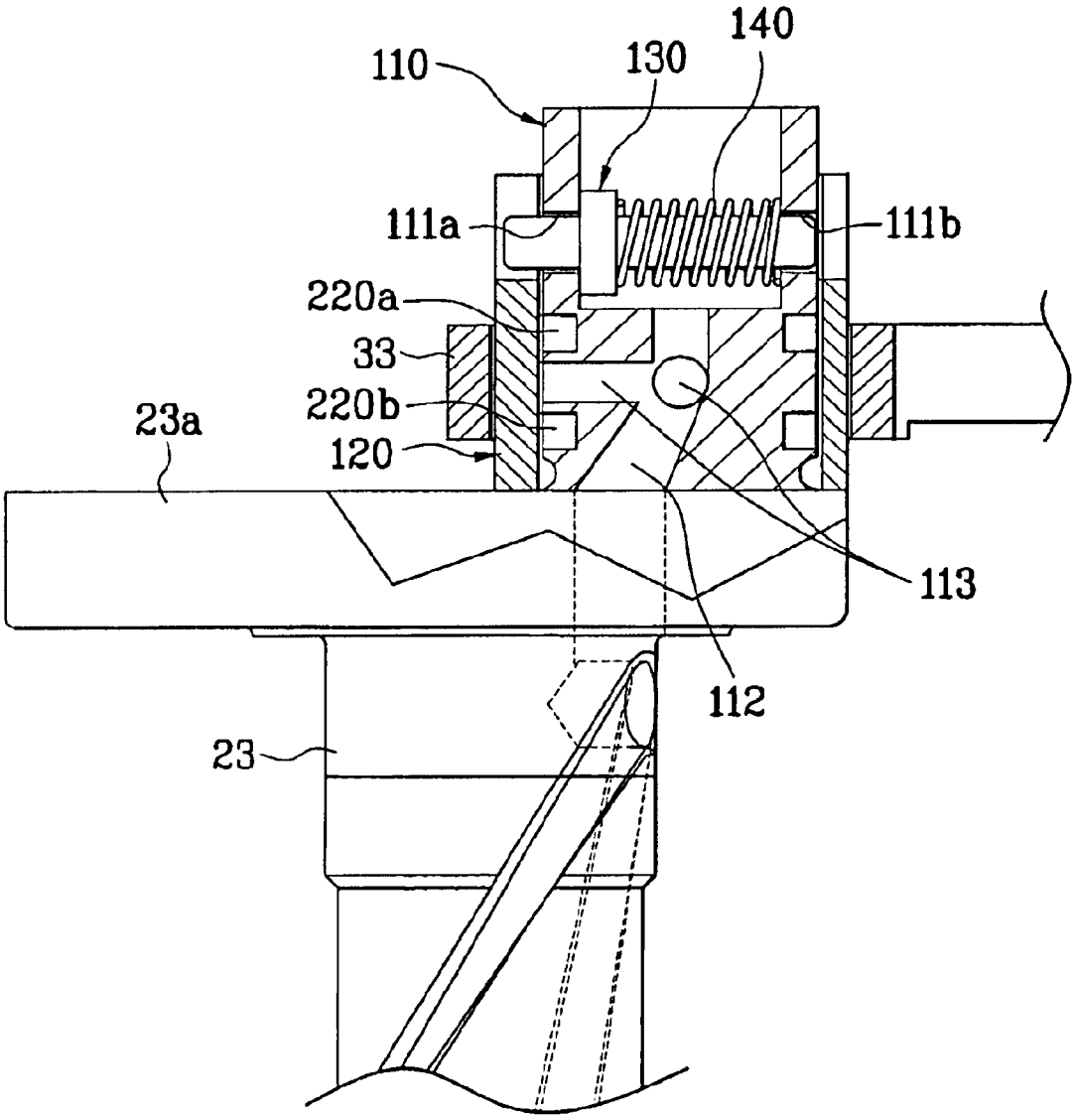
FIGS. 13A and 13B illustrate a side view, and a partially enlarged view of variations of an oil groove of the present invention, respectively.

Referring to FIGS. 12 and 13A, as one of embodiments, the damping means may be at least one groove 210 or 220 for receiving oil (i.e., lubricating oil). The groove 210 or 220 holds much oil actually, and the oil presents between other members inclusive of the eccentric sleeve 120 for providing damping effect.

As shown, the eccentric sleeve 120 is rotatably fitted to the crank pin 110, with a clearance therebetween for smoother relative motion. Moreover, opposite areas of the eccentric sleeve 120 and the crank pin 110 are large. Accordingly, there is a high probability that contact and impact occurred between the eccentric sleeve 120 and the crank pin 110. Taking the high probability into account, even though the groove 210 or 220 may be provided to respective members 33, 110, 120, and 130, it is advantageous that the groove is provided to the crank pin 110 and the eccentric sleeve 120 at first, for damping overall contacts and impacts. Moreover, since the eccentric sleeve 120 is thinner than the crank pin 110 relatively, in a case the groove 210 or 220 is formed in the eccentric sleeve 120, the eccentric sleeve 120 may have a poor strength. Therefore, it is preferable that the groove 210 or 220 is formed on an outside circumferential surface of the crank pin 110 opposite to the eccentric sleeve 120.

In more detail, the groove 210 or 220 may be continuous around the outside circumferential surface. However, for prevention of substantial strength drop of the crank pin 110, it is preferable that the groove 210 or 220 is intermittent around the outside circumferential surface. That is, in this case, a plurality of discontinuous unit grooves 210 or 220 are formed along the outside circumferential surface of the crank pin 110. As shown in FIG. 12, the groove 210 may be formed in a central part of the crank pin 110. The groove 210 is positioned in a central part of the outside circumferential surface of the crank pin 110 so that the large amount of oil in the groove 210 faces a central part of an inside circumferential surface of the eccentric sleeve 120 for damping the contact and impact between the crank pin 110 and the eccentric sleeve 120, uniformly. The groove 210 is in communication with the oil passage 112 in the crank shaft 23, for receiving the oil from the bottom of the compressor through the oil passage 112, and hold a certain amount of the oil, always. In more detail, the oil passage 112 has a supplementary passage branch therefrom connected to the groove 210, which may be the oil supply hole 113 described before. There may be more than one supplementary passages, and it is preferable that the supplementary passages are spaced apart from each other if there are a plurality of the supplementary passages.

Figure 13B:
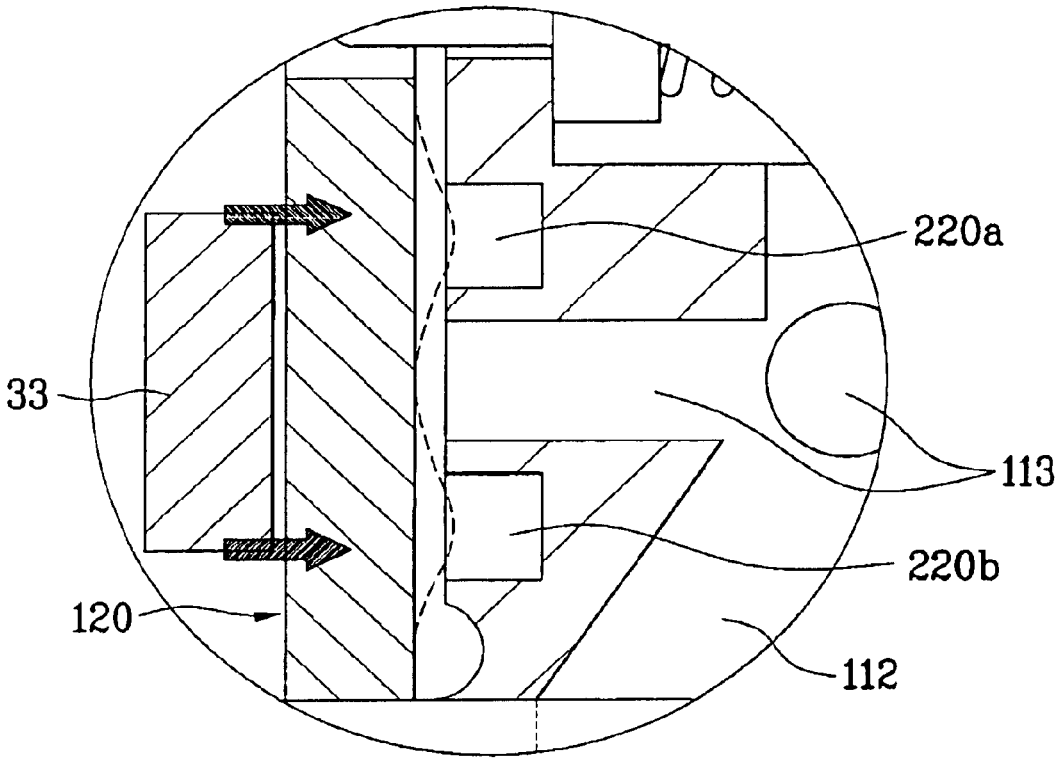

In the meantime, while the working fluid is compressed, a pressure of the working fluid is applied to the eccentric sleeve 120 as a reaction force through the piston 31 and the connecting rod 33, to deform the comparatively thin eccentric sleeve 120 between the connecting rod 33 and the crank pin 110. As shown in FIG. 13B, since central parts of the connecting rod 33 and the eccentric sleeve 33 are in contact with each other uniformly, the pressure acts as a distributed load in the central parts so as not to cause great deformation. However, action of the pressure on parts of the eccentric sleeve 120 in contact with an upper part and a lower part of the connecting rod 33 as concentrated loads causes great deformation of the parts toward the crank pin 110 as shown in dashed line. The deformed parts makes direct contact and impact to the crank pin 110, to cause intensive wear and noise. Therefore, to cope with such a case, the grooves 220*a* and 220*b* are formed in an upper part and a lower part of the outside circumferential surface of the crank pin 110 so as to opposite to the upper part and the lower part of the connecting rod 33. That is, the grooves 220*a* and 220*b* are formed in the outside circumferential surface of the crank pin 110 on at least the same planes with the upper part and the lower part of the connecting rod 33, respectively. Alike the central groove 210 described before, the oil held in the grooves 220*a* and 220*b* face the upper part and the lower part of the inside circumferential surface of the eccentric sleeve 120, and attenuate the contact and impacts between the crank pin 110 and the eccentric sleeve 120, uniformly. Particularly, the oil can support the upper part and the lower part of the eccentric sleeve 120 by means of its own viscosity. Accordingly, the deformations of the upper part and lower part of the eccentric sleeve 120 are reduced actually, and at the same time with this, the contact and the impact between the crank pin 110 and the eccentric sleeve 120 caused by the deformation are prevented. Along with this, as shown in FIG. 13, even in a case the upper/lower parts of the eccentric sleeve 120 are deformed excessively, the grooves 220*a* and 220*b* can receive parts of the eccentric sleeve 120 to prevent the contact and impact. Alike the groove 210 in FIG. 12, the grooves 220*a* and 220*b* may be connected to the oil passage 112 and the supplementary passage, i.e., the oil supply hole 113. However, it is difficult to form the supplementary hole to connect all the grooves 220*a* and 220*b* in the crank pin 110 to the oil passage 112 actually, and moreover the formation of the supplementary hole to connect all the grooves 220*a* and 220*b* in the crank pin 110 to the oil passage 112 reduces a strength of the crank pin 110. Therefore, as shown in FIG. 13A, preferably, the grooves 220*a* and 220*b* are not connected to the oil passage 112 with a separate supplementary passage, but, instead, has oil supplied thereto through a gap between the eccentric sleeve 120 and the crank pin 110. That is, the oil is supplied to the gap between the eccentric sleeve 120 and the crank pin 110 through the oil supply hole 113, and therefrom to the grooves 220*a* and 220*b*. The crank pin 110 may includes the grooves 220*a* and 220*b* in FIG. 13A or the groove 210 in FIG. 12, or both of them.

In the meantime, as other embodiment of the damping means of the present invention, separate from the grooves 210 and 220, the damping means may be a damping member attached to the eccentric sleeve 120 and the members adjoining thereto. That is, while the grooves 210 and 220 and the oil, fluid held therein, serve as the damping means in FIGS. 12 and 13, in the following embodiments, a solid damping member is employed as the damping means. Similar to the foregoing embodiment, the damping member is interposed between the members including the eccentric sleeve 120 directly, for providing a damping effect.

A first embodiment 311 of the damping member is provided between the eccentric sleeve 120 and the crank pin 110, with first priority. As described before, this is because it is highly probable that the eccentric sleeve 120 and the crank pin 110 come into contact with, or hit each other, due to a gap and an actual large expected contact area between the eccentric sleeve 120 and the crank pin 110. The damping members 311 and 312 of the first preferred embodiment may be attached both to the inside and outside circumferential surfaces of the eccentric sleeve 120. However, even in a case the damping member 311 or 312 is attached one of the opposite surfaces (i.e., the outside and inside circumferential surfaces) of the eccentric sleeve 120 and the crank pin 110, an adequate damping effect can be provided.

Figure 14A:
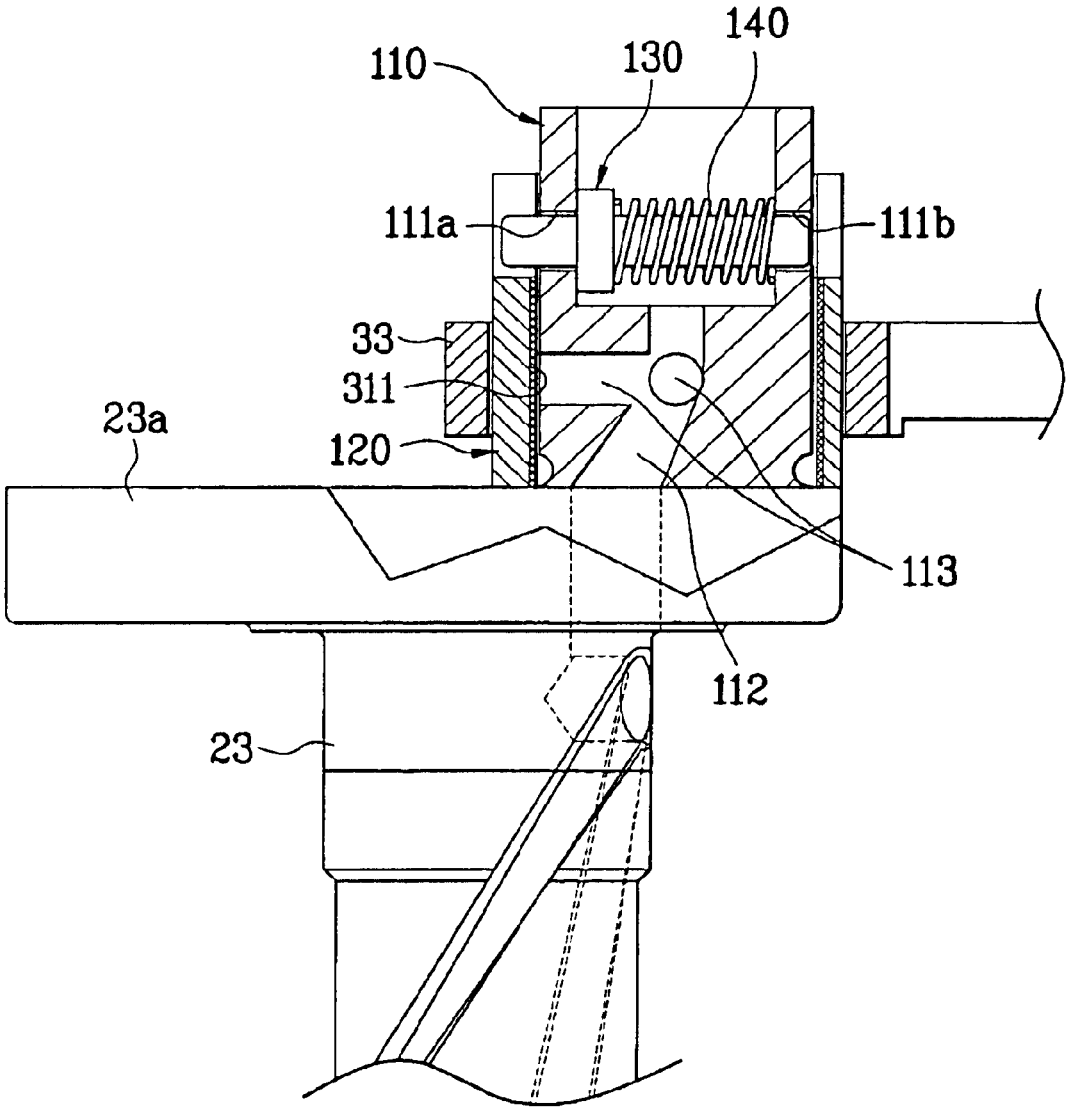
FIGS. 14A and 14B illustrate side views each showing a damping member of a dual capacity compressor in accordance with a first preferred embodiment of the present invention.
Figure 14B:
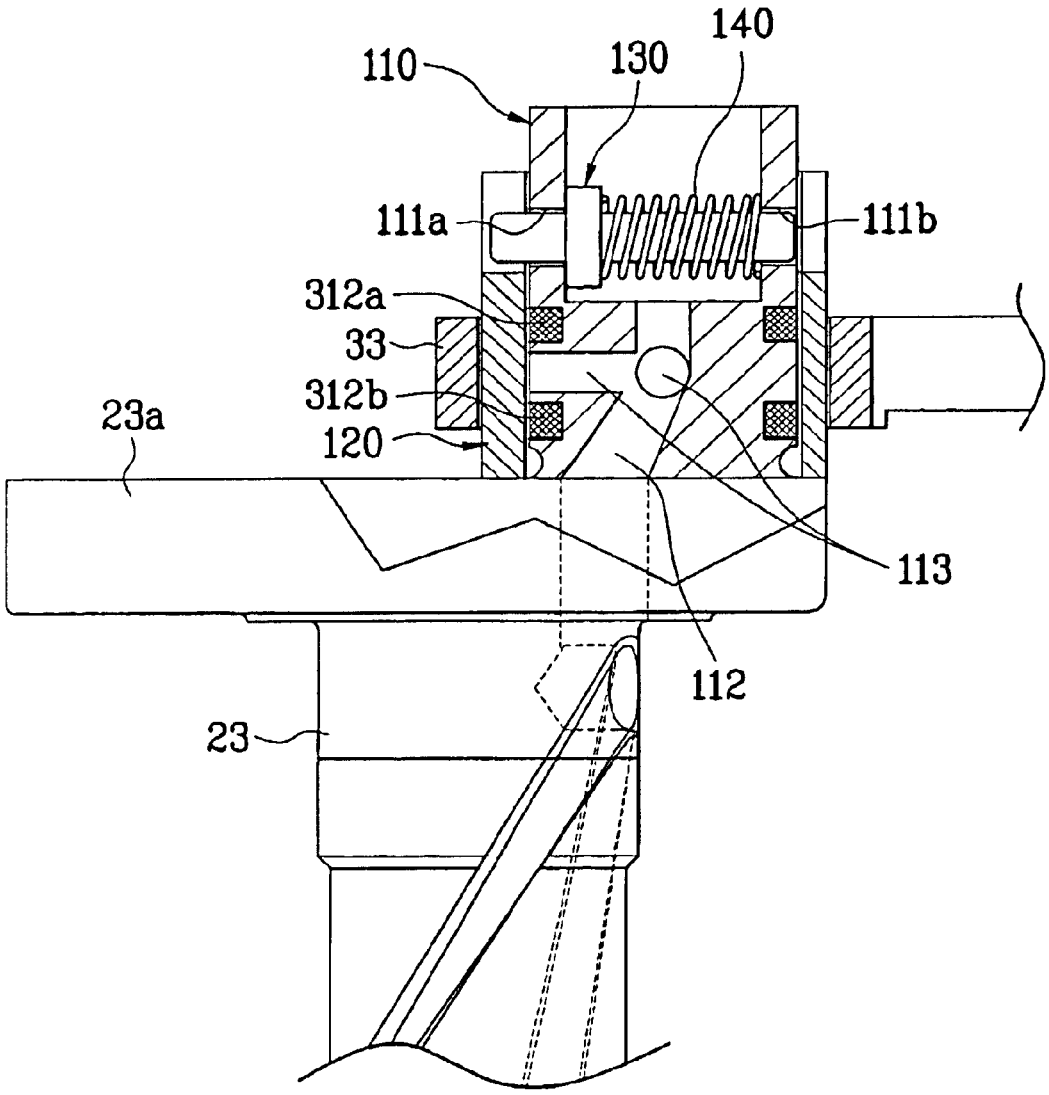

In more detail, in a case the damping member is formed on the outside circumferential surface of the crank pin 110, the damping member interferes with the oil supply hole 113, to impede smooth supply of oil between the crank pin 110 and the eccentric sleeve 120. Therefore, as shown in FIG. 14A, preferably, the damping member 311 is provided to the inside circumferential surface of the eccentric sleeve 120. As shown, in this case, the damping member 311 can be a bush covering the inside circumferential surface of the eccentric sleeve 120. The bush 311 may cover a part of the inside circumferential surface of the eccentric sleeve 120. That is, a plurality of bushes 311 may be attached to the inside circumferential surface of the eccentric sleeve 120 at regular intervals. However, for uniform damping of the contact and the impact between the eccentric sleeve 120 and the crank pin 110, it is preferable that the bush 311 covers an entire surface of the inside circumferential surface of the eccentric sleeve 120. The bush 311, interposed between the eccentric sleeve 120 and the crank pin 110, prevents the crank pin 110 and the eccentric sleeve 120 from coming into contact and impact to each other, and absorbs an impact. The bush 311 may be provided to the outside circumferential surface of the crank pin 110, when it is required that the bush 311 has a through hole for opening the oil supply hole 113 so as not to impede the oil supply. Or alternatively, instead of the bush 311, a thickness of coated layer may be formed on the inside circumferential surface of the eccentric sleeve 120, or the outside circumferential surface of the crank pin 110.

Moreover, as described, the pressure of the working fluid deforms the eccentric sleeve 120 such that the eccentric sleeve comes into contact with, and hit the crank pin 110, directly. Therefore, for preventing contact and hit caused by such a deformation, it is preferable that the damping member 312 is fitted to the outside circumferential surface of the crank pin 110 rather than the inside circumferential surface of the eccentric sleeve 120. Particularly, since the upper part and the lower part of the connecting rod 33 cause large deformation of the eccentric sleeve 120 with concentrated loads (see FIG. 13B), the damping members 312*a* and 312*b* are provided to the upper part and the lower part of the outside circumferential surface of the crank pin 110 such that the damping members 312*a* and 312*b* are on the same planes with the upper part and the lower part of the connecting rod 33. In this case, as shown, the damping members 312*a* and the 312*b* are ring members inserted in the outside circumferential surface of the crank pin 110, actually. In more detail, the crank pin 110 has seats each with a certain depth in the upper part and the lower part, into which the ring members 312*a* and the 313*b* are inserted, rigidly. Alike the bush 311, the ring members 312*a* and the 312*b* prevents contact and hit between the crank pin 110 and the eccentric sleeve 120, and absorbs impact. Particularly, since the ring members 312*a* and 312*b* support the upper part and the lower part of the eccentric sleeve 120 respectively, the ring members 312*a* and 312*b* suppress large deformation of the upper and lower parts of the eccentric sleeve 120, and at the same time, prevents deformed parts from coning into contact with the crank pin 110. The ring members 312*a* and 312*b* may be provided to the outside circumferential surface of the crank pin 110 for the same effect.

In a first embodiment of the damping member, both the bush 311 and the ring members 312*a* and 312*b* may be provided to the crank pin 110 and the eccentric sleeve 120, when the bush 311 may be provided to the inside circumferential surface of the eccentric sleeve 120, and the ring members 312*a* and the 312*b* may be provided to the outside circumferential surface of the crank pin 110.

Figure 15:
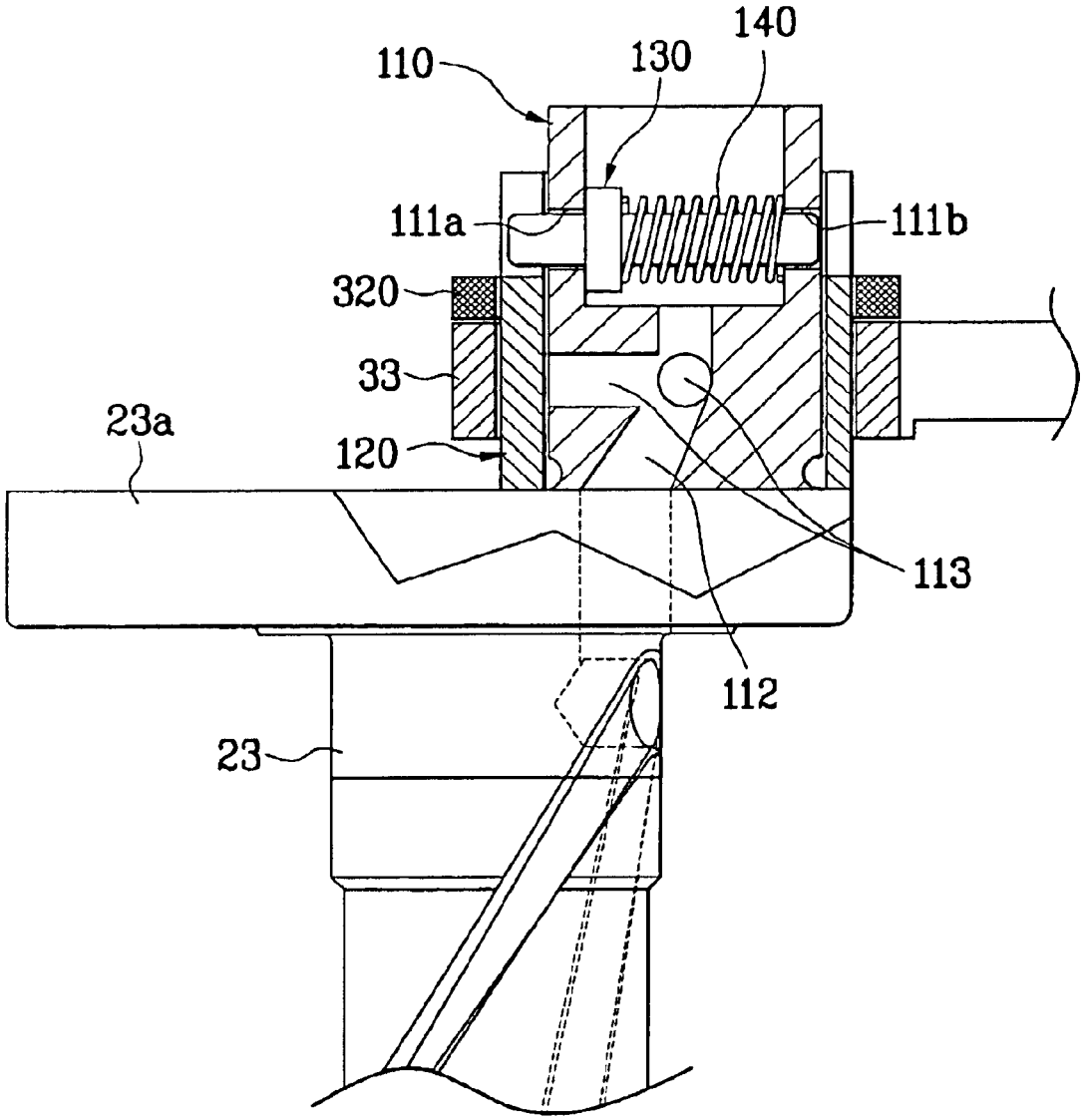
FIG. 15 illustrates a side view of a damping member in accordance with a second preferred embodiment of the present invention.

In the meantime, a ring shaped end of the connecting rod 33 has a predetermined gap with respect to the eccentric sleeve 120 for smooth rotation around the eccentric sleeve 120. Therefore, the end of the connecting rod 33 may come into contact with, and hit the eccentric sleeve 120 while the end of the connecting rod 33 moves up/down on the outside circumferential surface of the eccentric sleeve 120 during rotation. As shown in FIG. 15, for eliminating such contact and hit, the damping member 320 in accordance with a second preferred embodiment of the present invention is provided to the eccentric sleeve 120 adjacent to the connecting rod 33. The second embodiment 320 of the damping member may be formed in the upper part and the lower part of the eccentric sleeve 33 adjacent to the connecting rod 33. The end of the connecting rod 33 may give damage to the upper part, or the eccentric sleeve 120 breaks away from the eccentric sleeve 120 to upward, when the end of the connecting rod 33 has a momentary great force applied thereto from the working fluid. Opposite to this, the end of the connecting rod 33 does not break away from the eccentric sleeve 120 at least in downward by the balance weight 23*a*. Therefore, as shown, the damping member 320 is preferably provided to the upper part of the outside circumferential surface of the eccentric sleeve 120.

In more detail, the damping member 320 may be a radial direction projection from the outside circumferential surface of the eccentric sleeve 120. Or, the damping member 320 may be a ring member fixed to the upper part of the outside circumferential surface of the eccentric sleeve 120. Preferably, a part of the damping member 320 facing the connecting rod 33 is flat for uniform supporting. That is, a bottom surface of the damping member 320 in the drawing is flat for uniform contact with a top surface of the connecting rod 33. The damping member 320 prevents contact and collision between the eccentric sleeve 120 and the connecting rod 33, and particularly, the damping member 320 is provided on top of the eccentric sleeve 120, the damping member 320 also prevents break away of the connecting rod 33.

Figure 16A:
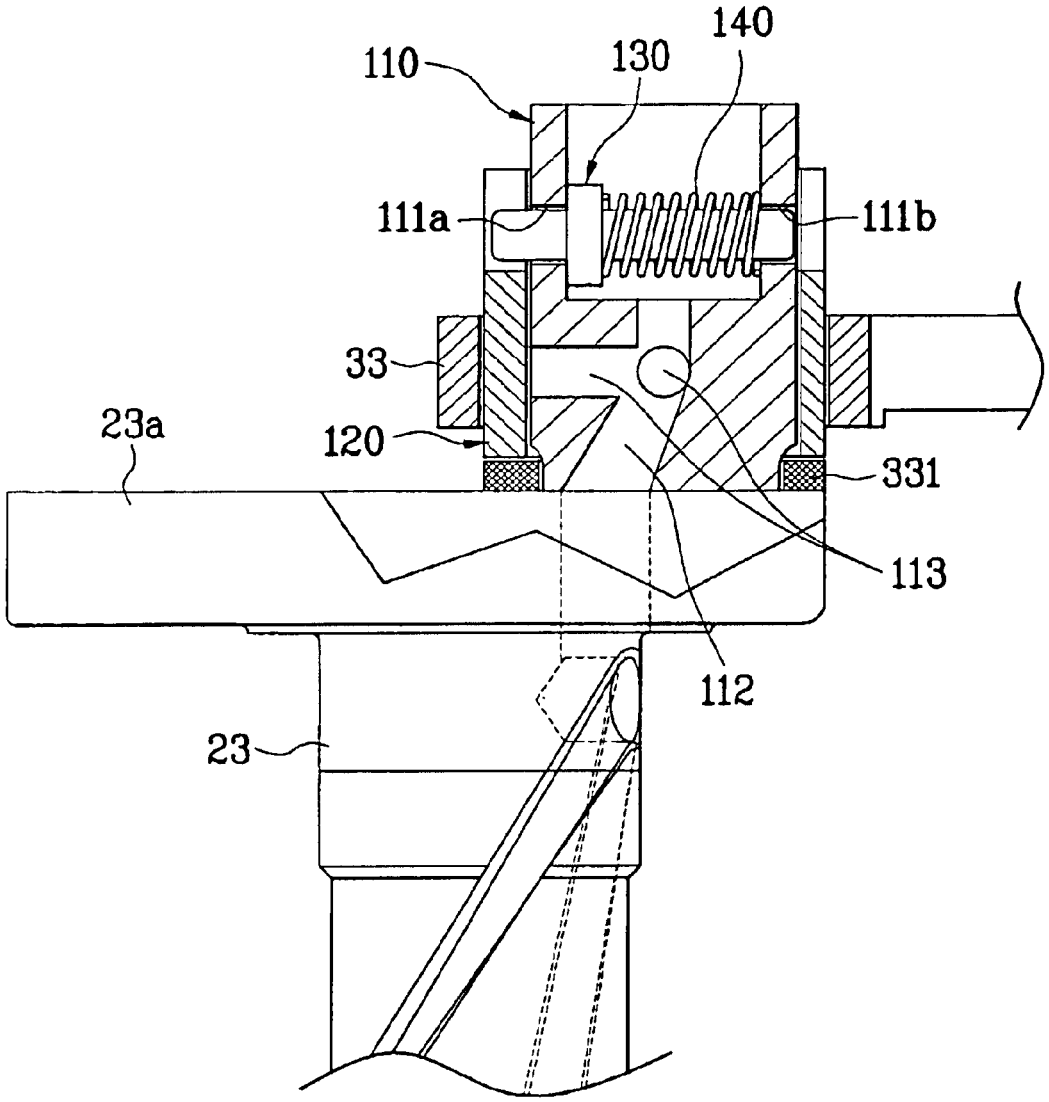
FIGS. 16A and 16B illustrate side views each showing a damping member of a dual capacity compressor in accordance with a third preferred embodiment of the present invention.
Figure 16B:
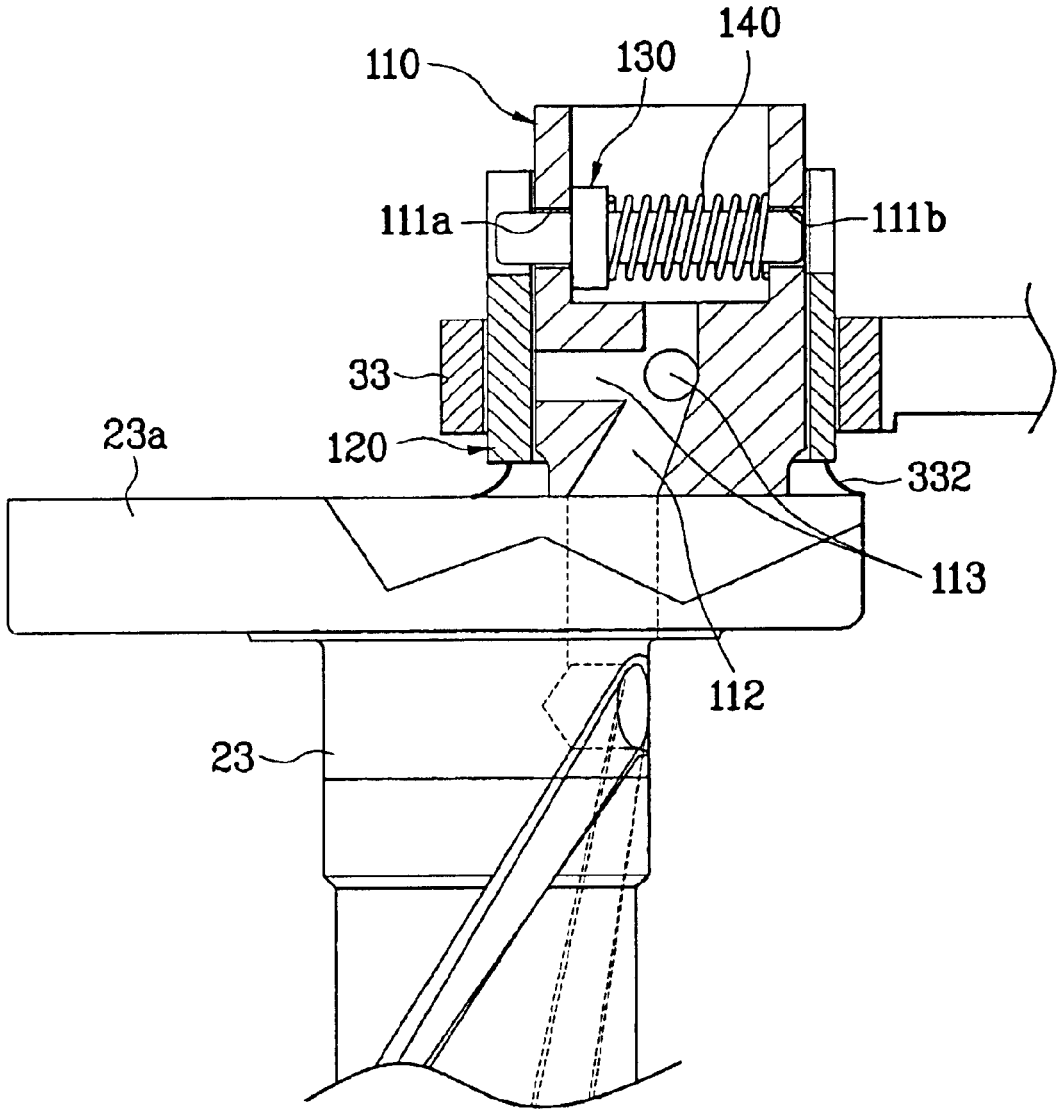

On the other hand, as shown, the eccentric sleeve 120 is rotatably fitted to the crank pin 110 as well as rotatably supported on the balance weight 23*a*. The balance weight connects the crank pin 110 and the crank shaft 23, and is positioned below the eccentric sleeve 120, for stable rotation of the crank shaft 23 and the crank pin 110 eccentric from the crank shaft 23. It is liable that the eccentric sleeve 120 moves in up/down directions on the outside circumferential surface of the crank pin 110 and comes into contact with, and hits the balance weight 23*a* during rotation. Therefore, as shown in FIGS. 16A and 16B, the damping member 331 or 332 of the third embodiment is provided between the eccentric sleeve 120 and the balance weight 23*a*. The damping member of the third embodiment 331 or 332 is provided between the eccentric sleeve 120 and the balance weight 23*a*, and in more detail, under the eccentric sleeve 120 or on the balance weight 23*a*. However, for providing the damping member 331 or 332 under the eccentric sleeve 120, a fastening member is required, additionally. Therefore, preferably, the damping member 331 or 332 can be positioned stably on a top surface of the balance weight 23*a* without the fastening member. In more detail, as shown in FIG. 16A, the damping member 331 may be a ring member fitted around the crank pin 110 to support the eccentric sleeve 120. The ring member 311 interposed between the eccentric sleeve 120 and the balance weight 23*a*, can attenuate the contact and hit between the eccentric sleeve 120 and the balance weight.

Moreover, the eccentric sleeve 120 interferes with the key member 130 during the eccentric member 120 moves in an up/down direction on the crank pin 110. That is, during operation of the compressor, the track part 121 of the eccentric sleeve 120 hits an under side of the key member 130, intermittently. Therefore, it is preferable that the damping member 331,332 is formed such that the eccentric sleeve 210 supports the key member in close contact with the key member 130. The close contact of the eccentric sleeve 120 with the key member 130 can be made by means of the ring member 331, partly. However, as shown in FIG. 16, for absorbing a reaction force from the key member 130 in close contact therewith, and supporting the eccentric sleeve 120 to be in contact with the key member 130 continuously, it is more preferable that the damping member 332 is an elastic member with a predetermined elasticity. The elastic member 332 may be a plate spring or a coil spring around the crank pin 110, actually. Alike the ring member 331, basically the elastic member 332 can prevent the contact and hit between the eccentric sleeve 120 and the balance weight 332. Particularly, the elastic member 332 elastically supports the eccentric sleeve 120, and lifts the eccentric sleeve 120 from the balance weight 23*a*. Therefore, the eccentric sleeve 120 is in contact with the key member 140 continuously, to prevent the intermittent hitting and contact between the key member 130 and the eccentric sleeve 120. Moreover, the elastic member 332 elastically deforms, and absorbs the impact from the key member 130, effectively.

Figure 17A:
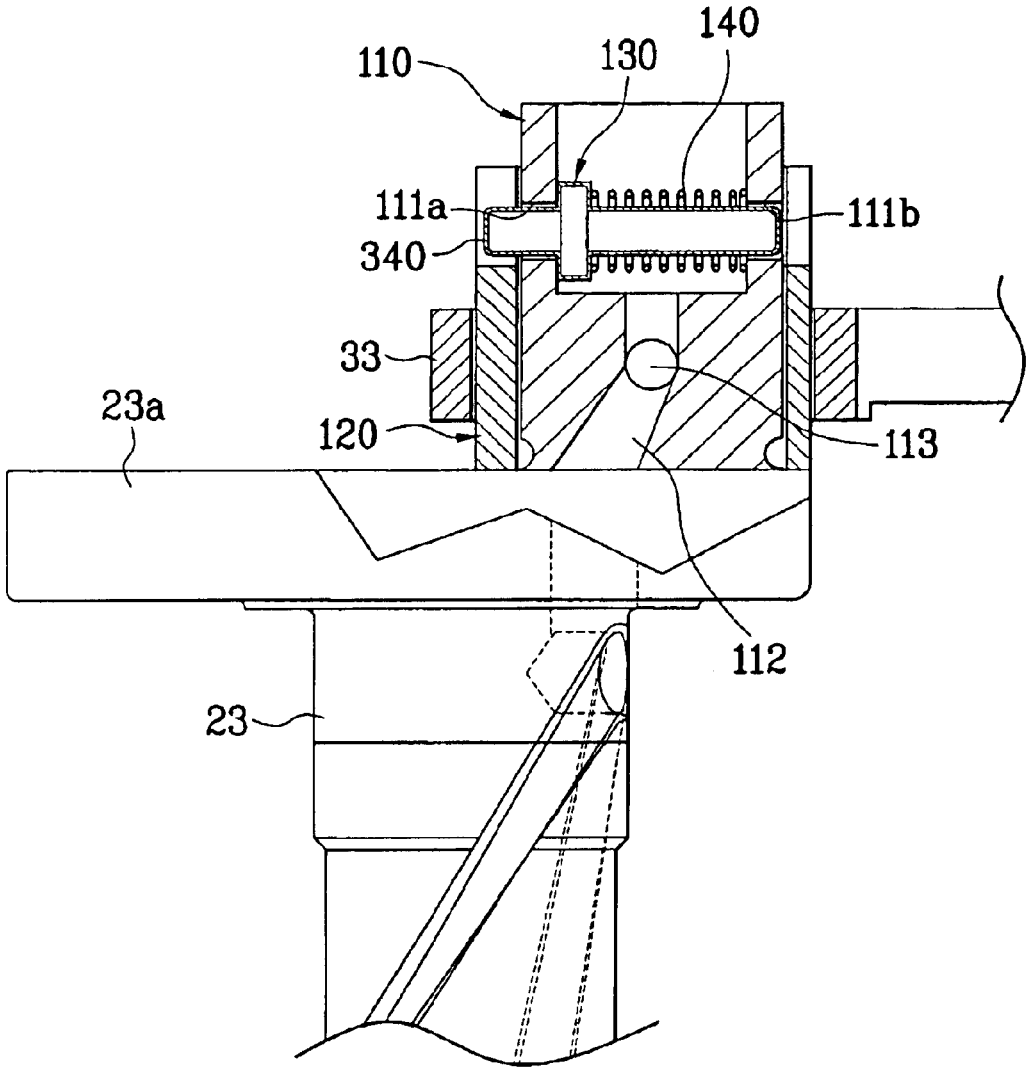
FIGS. 17A and 17B illustrate side views each showing a damping member of a dual capacity compressor in accordance with a fourth preferred embodiment of the present invention.
Figure 17B:
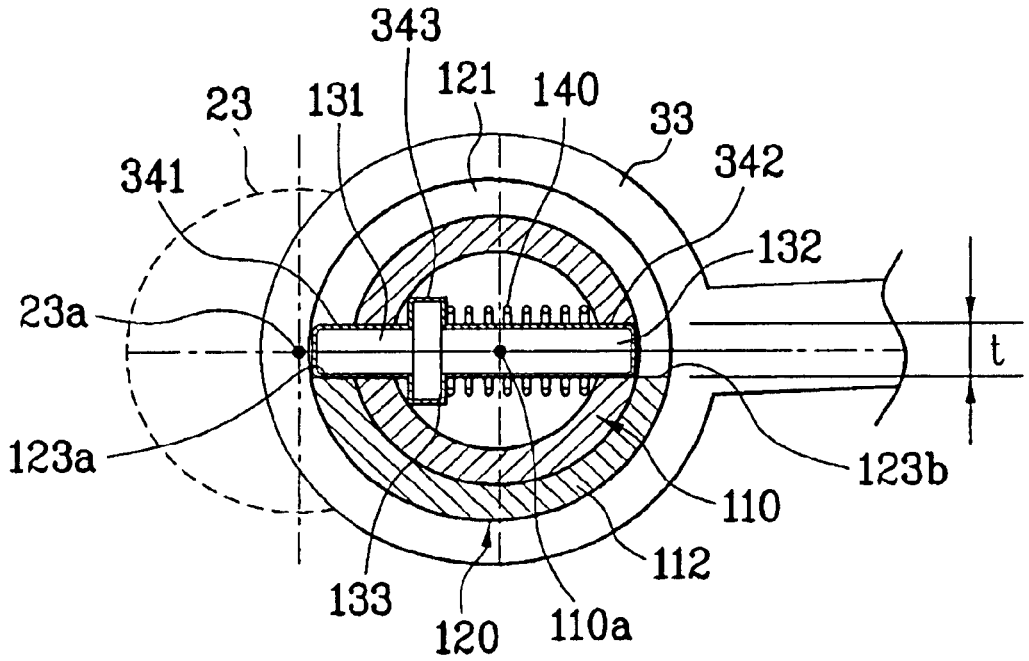

Lastly, the key member 130 adjoins the crank pin 110 and the eccentric sleeve 120. Particularly, key member 130 hits one of the steps 123*a* and 123*b* every time the rotation direction of the compressor changes, and is in contact with either one of the steps 123*a* and 123*b*, continuously. Therefore, as shown in FIGS. 17A and 17B, for prevention of such hitting and contact, a damping member 340 in accordance with a fourth preferred embodiment is provided to the key member 130. Moreover, it is preferable that such a damping member 340 is fitted to an outside circumferential surface of the key member 130, a possible contact area of the key member 130 with other members 110 and 120. As shown, in this case the damping member 340 may be a bush covering the outside circumferential surface of the key member 130. For uniform damping of the contact and hitting between the key member 130 and the other members 110 and 120, it is preferable that the bush 340 covers an entire outside circumferential surface of the key member 130. In more detail, the bush 340 includes a first bush 341 covered on the first projection 131, a second bush 342 covered on the second projection 132, and a third bush 343 covered on the stopper 133. The bush 340 is interposed between the key member 130, the eccentric sleeve 120, and the crank pin 110, and prevents them from contacts and hitting between them. Moreover, instead of the bush 340, a thickness of coated layer may be formed on the outside circumferential surface of the key member 130.

In the first to fourth embodiments described before, if the damping member is formed of a material having a hardness higher than the members 33, 110, 120, and 130, the members may be worn by the damping member, in contrary. Moreover, for absorbing impact coming from hitting, it is even required that the damping member has a little elasticity. Accordingly, in the embodiments, it is preferable that the damping members 311~340 are formed of a non-ferrous metal, such as aluminum, or a polymer material, such as plastic, rubber, and Teflon.

Figure 18A:
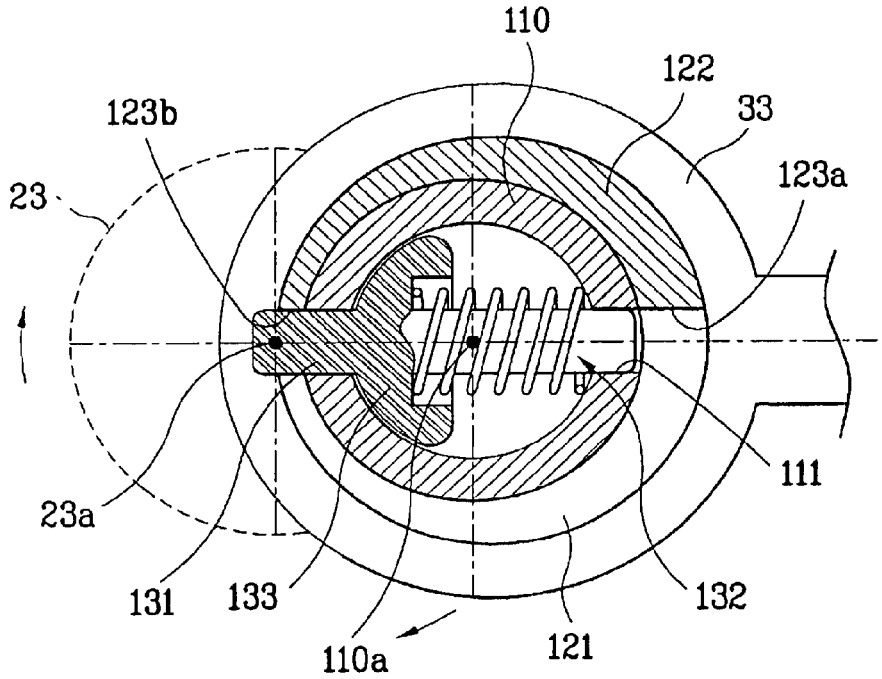
FIGS. 18A and 18B illustrate plan views each showing operation of a dual capacity compressor of the present invention in a clockwise direction rotation.
Figure 18B:
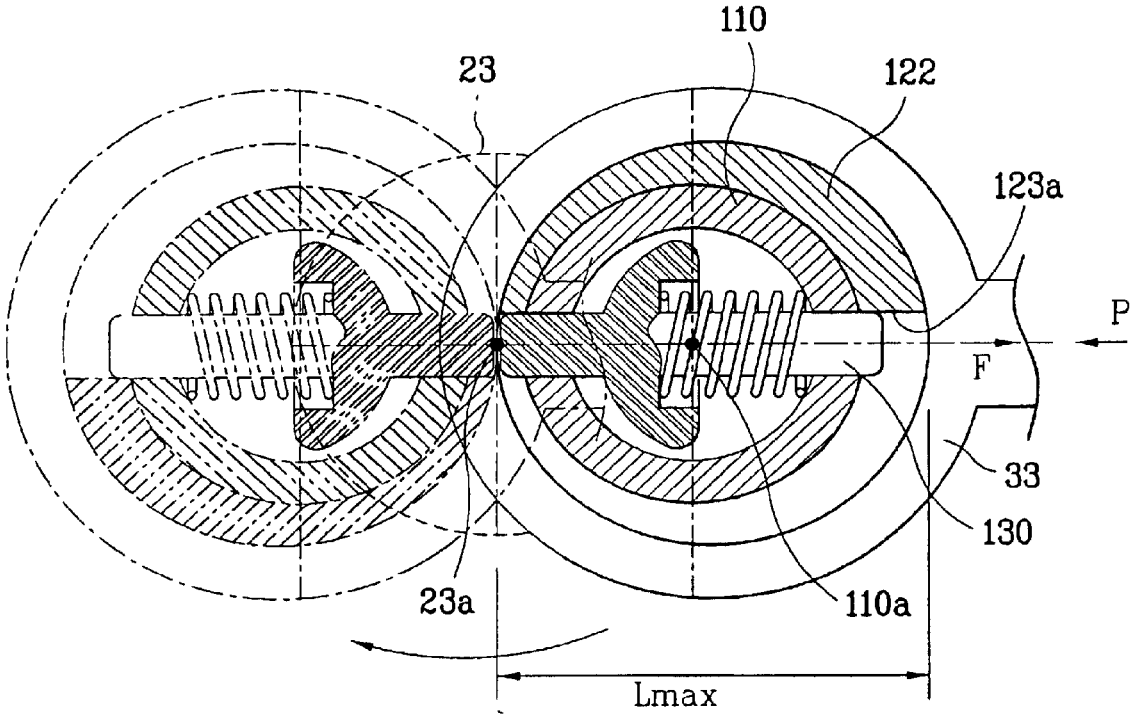
Figure 19A:
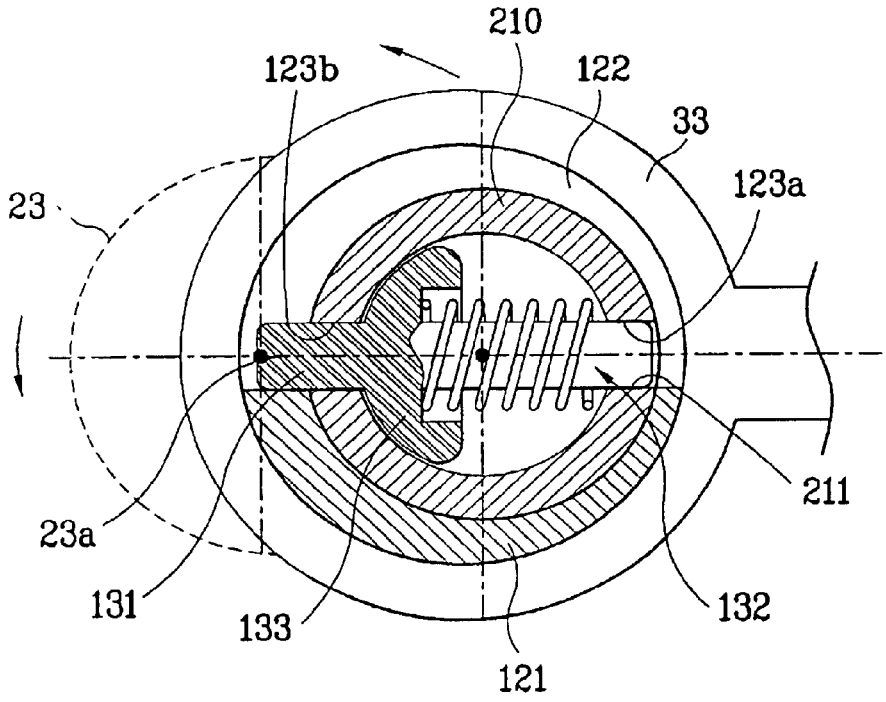
FIGS. 19A and 19B illustrate plan views each showing operation of a dual capacity compressor of the present invention in a counter clockwise direction rotation.
Figure 19B:
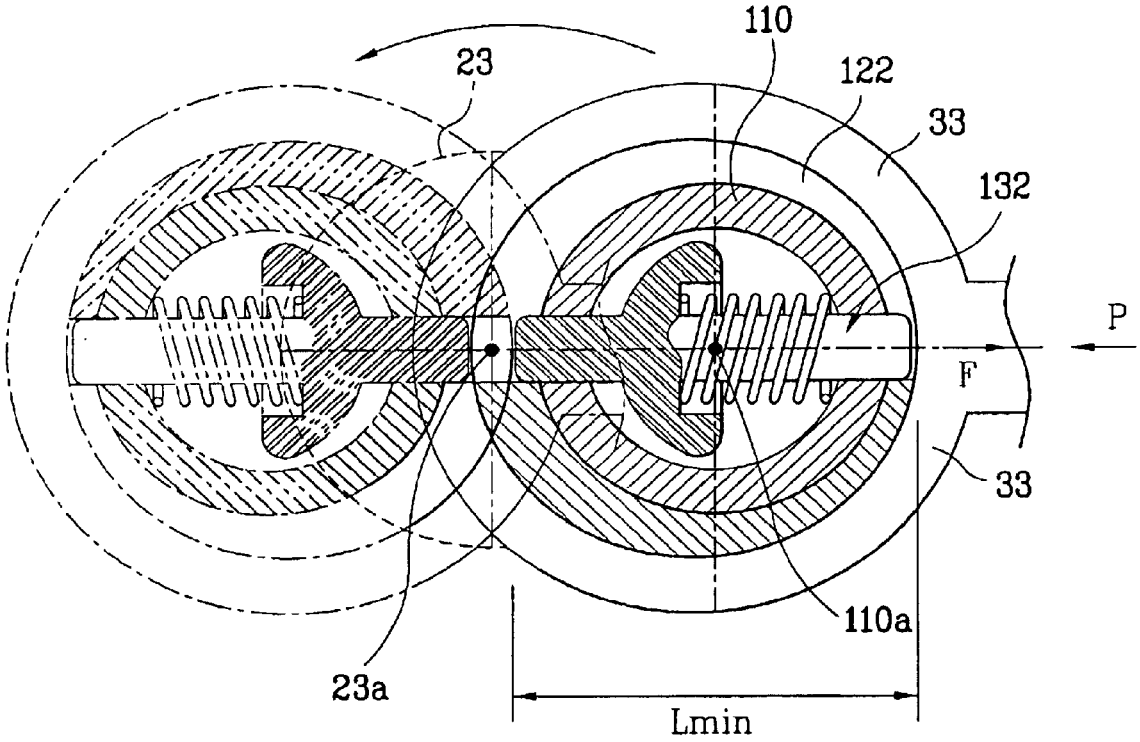

The operation of the dual capacity compressor of the present invention will be described with reference to the attached drawings. FIGS. 18A and 18B illustrate plan views each showing operation of a dual capacity compressor of the present invention in a clockwise direction rotation, and FIGS. 19A and 19B illustrate plan views each showing operation of a dual capacity compressor of the present invention in a counter clockwise direction rotation.

FIG. 18A illustrates a relative position between the key member 130 and the eccentric sleeve 120 when the crank shaft starts to rotate in a regular direction, i.e., a clockwise direction. As described, the first projection 131 is always projected from the crank pin 110 by an elastic force in a direction inward of a radius of the crank pin 110. In a state the first projection 131 is projected, if the crank shaft 23 starts to rotate in the clockwise direction, the crank pin, the eccentric sleeve, and the key members 110, 120, and 130 start to revolve around the axis 23*a* of the crank shaft in the clockwise direction. During the revolution, there is a relative friction force between the crank pin 110 and the connecting rod 33 in a direction opposite to the rotation direction. According to this, the eccentric sleeve 120 rotates around the crank pin 110*a* in a counter clockwise direction by the friction force, until the step 123*b* at the thin side is caught at the first projection 131. If the crank shaft 23 rotates once, since the friction force is generated continuously during rotation of the crank shaft 23, the caught state between the first projection 131 and the step 12*b* is continued. In this instance, as shown in FIG. 18B, if the rotating angular speed reaches to a certain level, the key member 130 moves along a direction of action of the centrifugal force 'F', i.e., the extension line between the axes 23*a* and 110*a* by the centrifugal force ' F'. According to this, the second projection 132 is engaged with the step 223*a* at the thick side, and the first projection also maintains a state of contact with the step 123*b* at the same time. This multiple point simultaneous contact enables the key member 130 to be in full engagement with the eccentric sleeve 120. Therefore, in the regular direction rotation, even if an external force 'P' from expansion of the working fluid after the compression, and other forces are received through the connecting rod 330, relative rotation between the crank pin 210 and the eccentric sleeve 220 is prevented. Also, in a case a local rotational moment is generated at the eccentric sleeve 120, a relative rotation of the eccentric sleeve 120 with respect to the crank pin 110 can be prevented. Also, as shown in FIG. 18B, a solid line part in the drawing illustrates a top dead center state and a dashed line part in the drawing illustrates a bottom dead center state, and the eccentric sleeve 220 is arranged so as to generate the greatest eccentricity between the piston (not shown) connected to the connecting rod 33 and the crank pin 110, in the regular directional rotation. Accordingly, the piston reciprocates in the greatest stroke length Lmax, and the compressor of the present invention has a maximum compression capacity.

In the meantime, if the crank shaft 23 starts to rotate in a reverse, i.e., the counter clockwise direction, the relative friction force is generated between the crank pin 110 and the connecting rod 33 in an opposite direction of the rotation direction, i.e., in the counter clockwise direction. Then, the eccentric sleeve 120 rotates in the clock direction around the axis of the crank pin 110*a* starting from a position shown in FIG. 18A, until the step 123*a* at the thick side is engaged with the first projection 131 as shown in FIG. 19A. Alikely, during rotation of the crank shaft 23, the state of catch between the first projection 131 and the step 123*a* is maintained by the friction force. Alike the regular direction rotation, as shown in FIG. 19B, if a rotational angular speed reaches to a certain level, the second projection 232 is engaged with the step 123*b* at the thin side by the centrifugal force 'F', such that the multiple point contact state is made between the eccentric sleeve 120 and the key member 130. Therefore, in the reverse direction rotation, even if the external force 'P' from the pressure the working fluid exerts to the piston during the compression, and any other forces are received, the relative rotation between the crank pin 110 and the eccentric sleeve 120 can be prevented. Also, as shown in FIG. 19B, in a case of the reverse direction rotation, since the eccentric sleeve 120 is arranged to have a minimum eccentricity, the piston reciprocates in a minimum stroke length Lmin, such that the compressor of the present invention has a minimum compression capacity.

At the end, by eliminating the relative motion between parts that maintain the eccentricity by means of the key member 130, i.e., the crank pin 110 and the eccentric sleeve 120 perfectly, the compressor of the present invention can make stable operation in any state of operation, i.e., in the regular or reverse direction rotation.

Moreover, during operation of the compressor, the grooves 210, 220*a*, and 220*b* holds a substantial amount of oil, interposed between the members, particularly, between the eccentric sleeve 120 and the crank pin 110. The grooves 210, 220*a*, and 220*b* keeps supplying an adequate amount of oil to form a thick oil film between the eccentric sleeve 120 and the crank pin 110, and a substantial amount of oil itself held in the grooves functions as a damping member. Therefore, the contact, hitting, and deformation between the eccentric sleeve 120 and the crank pin 110 are dampened, to prevent the wear and noise between the members.

Furthermore, alike the grooves 210, 220*a*, and 220*b* and the oil, the damping members 311~340 are also interposed between the members 33, 110, 120, and 130, to prevent the contact, hitting, and deformation between the members 33, 110, 120, and 130. Therefore, owing to the damping members 311~340, wear and noise of the members 33, 110, 120, and 130 are suppressed.

The advantages of the dual capacity compressor of the present invention will be described.

In the present invention, basically, as the eccentric sleeve and the key member come into contact with each other in a multiple points during operation, the crank pin the key member is fitted thereto is also coupled with the eccentric sleeve, positively. Therefore, since relative motion between the eccentric sleeve and the crank pin is prevented despite of any external or internal cause, the compressor can make stable operation without variation of an output. That is, a constant amount of eccentricity is maintained, a designed compression can be obtained without change. Moreover, friction loss caused by the crank pin and the eccentric sleeve is prevented. At the end, the stable operation brings about an increase of the dual capacity compressor. In addition to this, noise coming from the relative rotation is prevented, and lifetimes of the parts can also be increased.

Furthermore, the damping means of fluid or solid is interposed between the eccentric sleeve and members adjoining the eccentric sleeve, to prevent contacts and hitting between them. Therefore, the wear and noise of the members occurred during operation are reduced or prevented, according to which a reliability and a lifetime of the compressor increase.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A dual capacity compressor comprising:

a power generating part including a reversible motor and a crank shaft inserted in the motor;

a compression part including a cylinder, a piston in the cylinder, and a connecting rod connected to the piston;

a crank pin in an upper part of the crank shaft eccentric to an axis of the crank shaft;

an eccentric sleeve having an inside circumferential surface rotatably fitted to an outside circumferential surface of the crank pin, and an outside circumferential surface rotatably fitted to an end of the connecting rod;

a key member for coupling the eccentric sleeve with the crank pin positively in all rotation directions of the motor; and damping means for damping impact occurred between the eccentric sleeve and members adjoin thereto;

thereby providing different compression capacities by re-arranging the eccentric sleeve that changes an effective eccentricity and a piston displacement following change of a direction of rotation of the motor, and preventing relative motion between the crank pin and the eccentric sleeve during operation by means of the key member actually regardless of the direction of rotation of the motor.

2. The dual capacity compressor as claimed in claim 1, wherein the key member is caught at at least a part of the eccentric sleeve continuously, and designed to be caught at the eccentric sleeve additionally.

3. The dual capacity compressor as claimed in claim 1, wherein the key member catches the eccentric sleeve at a plurality of points.

4. The dual capacity compressor as claimed in claim 1, wherein the key member catches the eccentric sleeve at two points set up with reference to a center line in any direction during operation.

5. The dual capacity compressor as claimed in claim 1, wherein the key member has a length greater than an outside diameter of the crank pin.

6. The dual capacity compressor as claimed in claim 1, wherein the crank pin includes one pair of key member fitting parts formed opposite to each other.

7. The dual capacity compressor as claimed in claim 1, wherein the key member fitting parts of the crank pin are through holes in a wall of the crank pin.

8. The dual capacity compressor as claimed in claim 1, wherein the eccentric sleeve includes;

a track part formed along a circumference thereof for enabling rotation of the eccentric sleeve itself relative to the projection of the key member, and a limiting part formed relative to the track part for limiting rotation of the projection of the key member.

9. The dual capacity compressor as claimed in claim 8, wherein the track part of the eccentric sleeve is a cut away part cut along a circumferential direction at a depth from a top thereof.

10. The dual capacity compressor as claimed in claim 8, wherein the track part of the eccentric sleeve is a pass through hole extended along a circumferential direction to a length at a depth from the top thereof.

11. The dual capacity compressor as claimed in claim 8, wherein the steps formed between the track part and the limiting part is parallel to an extension line connecting an axis of the crank shaft and an axis of the crank pin.

12. The dual capacity compressor as claimed in claim 11, wherein the step is spaced apart from an extension line connecting the axis of the crank shaft and the axis of the crank pin as much as a distance equal to a half of a thickness of the key member.

13. The dual capacity compressor as claimed in claim 1, wherein the key member includes;

a first projection for projection for a length from the crank pin even when the compressor is not in operation, and a second projection for projection for a length from the crank pin when the compressor is in operation.

14. The dual capacity compressor as claimed in claim 13, wherein the second projection has such a length that a tip thereof is not projected beyond the outside circumference of the crank pin when the compressor is not in operation.

15. The dual capacity compressor as claimed in claim 1, wherein the key member includes a stopper for limiting movement of the key member within the key member fitting parts.

16. The dual capacity compressor as claimed in claim 15, wherein the stopper has a crank pin contact surface in conformity with an inside circumferential surface of the crank pin.

17. The dual capacity compressor as claimed in claim 15, wherein the stopper is a first stopper for limiting one direction movement of the key member.

18. The dual capacity compressor as claimed in claim 15, wherein the stopper further includes a second stopper for limiting the other direction movement of the key member.

19. The dual capacity compressor as claimed in claim 1, wherein the key member further includes an elastic member for supporting the key member such that at least a part of the key member is kept projected out of the crank pin regardless of operation of the compressor.

20. The dual capacity compressor as claimed in claim 1, wherein the damping means is designed to prevent direct contact between the eccentric sleeve and members adjoin thereto.

21. The dual capacity compressor as claimed in claim 1, wherein the damping means includes at least one groove for holding oil so as to be interposed between the eccentric sleeve and the members adjoin thereto.

22. The dual capacity compressor as claimed in claim 21, wherein the groove is provided between the eccentric sleeve and the crank pin.

23. The dual capacity compressor as claimed in claim 21, wherein the groove is formed in an outside circumferential surface of the crank pin opposite to the eccentric sleeve.

24. The dual capacity compressor as claimed in claim 23, wherein the groove is formed in the outside circumferential surface of the crank pin intermittently, or around the outside circumferential surface, continuously.

25. The dual capacity compressor as claimed in claim 21, wherein the groove is in communication with an oil passage in the crank shaft for supplying oil to various driving parts of the compressor.

26. The dual capacity compressor as claimed in claim 21, wherein the groove is formed in a central part of the outside circumferential surface of the crank pin.

27. The dual capacity compressor as claimed in claim 21, wherein the groove is formed in an upper part and a lower part of the outside circumferential surface of the crank pin so as to opposite to an upper part and a lower part of the connecting rod fitted to the eccentric sleeve.

28. The dual capacity compressor as claimed in claim 21, wherein the groove receives a part of the eccentric sleeve deformed by a force applied thereto from the connecting rod.

29. The dual capacity compressor as claimed in claim 1, wherein the damping means includes damping members attached to the eccentric sleeve and members adjoin thereto.

30. The dual capacity compressor as claimed in claim 29, wherein the damping member is provided between the eccentric sleeve and the crank pin.

31. The dual capacity compressor as claimed in claim 30, wherein the damping member is fitted to an inside circumferential surface of the eccentric sleeve.

32. The dual capacity compressor as claimed in claim 31, wherein the damping member is a bush covering an entire inside circumferential surface of the eccentric sleeve.

33. The dual capacity compressor as claimed in claim 30, wherein the damping member is fitted to the outside circumferential surface of the crank pin.

34. The dual capacity compressor as claimed in claim 30, wherein the damping member is fitted to the upper part and the lower part of the outside circumferential surface of the crank pin so as to opposite to the upper part and the lower part of the connecting rod fitted to the eccentric sleeve.

35. The dual capacity compressor as claimed in claim 34, wherein the damping member is a ring member inserted in the outside circumferential surface of the crank pin.

36. The dual capacity compressor as claimed in claim 30, wherein the damping member is provided to a position between the eccentric sleeve and a balance weight of the crank shaft positioned under the eccentric sleeve.

37. The dual capacity compressor as claimed in claim 36, wherein the damping member is fitted on a top surface of the balance weight to support the eccentric sleeve.

38. The dual capacity compressor as claimed in claim 36, wherein the damping member is designed to support the eccentric sleeve to be in close contact with the key member.

39. The dual capacity compressor as claimed in claim 36, wherein the damping member is a ring member fitted to a circumference of the crank pin.

40. The dual capacity compressor as claimed in claim 36, wherein the damping member is an elastic member fitted to a circumference of the crank pin.

41. The dual capacity compressor as claimed in claim 40, wherein the damping member is a plate spring or a coil spring.

42. The dual capacity compressor as claimed in claim 29, wherein the damping member is provided to the eccentric sleeve adjacent to the connecting rod.

43. The dual capacity compressor as claimed in claim 42, wherein the damping member is provided to a top of the outside circumferential surface of the eccentric sleeve.

44. The dual capacity compressor as claimed in claim 42, wherein the damping member the damping member is a projection extended from the upper part of the outside circumferential surface of the eccentric sleeve in a radial direction.

45. The dual capacity compressor as claimed in claim 42, wherein the damping member is a ring member fitted to the upper part of the outside circumferential surface of the eccentric sleeve.

46. The dual capacity compressor as claimed in claim 29, wherein the damping member is provided to the key member.

47. The dual capacity compressor as claimed in claim 46, wherein the damping member is fitted to an outside circumferential surface of the key member.

48. The dual capacity compressor as claimed in claim 46, wherein the damping member is a bush that covers an entire outside circumferential surface of the key member.

49. The dual capacity compressor as claimed in claim 46, wherein the damping member is a coated layer formed on the outside circumferential surface of the key member.

50. The dual capacity compressor as claimed in claim 29, wherein the damping member is formed of a non-ferrous metal, or a polymer.

* * * * *